US009075371B2

(12) United States Patent
Ueno

(10) Patent No.: US 9,075,371 B2
(45) Date of Patent: Jul. 7, 2015

(54) IMAGE FORMING APPARATUS

(71) Applicant: CANON KABUSHIKI KAISHA, Tokyo (JP)

(72) Inventor: Takashi Ueno, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 13/727,760

(22) Filed: Dec. 27, 2012

(65) Prior Publication Data

US 2013/0195485 A1 Aug. 1, 2013

(30) Foreign Application Priority Data

Jan. 26, 2012 (JP) ..... 2012-014449

(51) Int. Cl.
*G03G 15/00* (2006.01)
*G03G 15/16* (2006.01)
*G03G 21/00* (2006.01)

(52) U.S. Cl.
CPC ..... *G03G 15/5054* (2013.01); *G03G 15/161* (2013.01); *G03G 15/5058* (2013.01); *G03G 21/00* (2013.01)

(58) Field of Classification Search
CPC ..... G03G 15/556; G03G 15/5058; G03G 15/504; G03G 15/161
USPC ..... 399/52, 264, 49, 123
See application file for complete search history.

(56) References Cited

U.S. PATENT DOCUMENTS

| | | | | |
|---|---|---|---|---|
| 7,218,870 | B2 | 5/2007 | Hirobe | |
| 2005/0213999 | A1 | 9/2005 | Hirobe | |
| 2011/0318033 | A1 * | 12/2011 | Takayanagi | 399/49 |

FOREIGN PATENT DOCUMENTS

| | | | |
|---|---|---|---|
| JP | 2002-311719 | A | 10/2002 |
| JP | 2003-345143 | A | 12/2003 |
| JP | 2005-128148 | A | 5/2005 |
| JP | 2005-274789 | A | 10/2005 |
| JP | 2009-288481 | A | 12/2009 |

* cited by examiner

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

An image forming apparatus includes a rotatable belt; a cleaning blade contacted to the belt; image forming stations including a first station and a second station for forming first and second adjustment toner images, respectively, on the belt, the second station being disposed downstreammost position, and the first station being disposed upstream of the second station and downstream of the cleaning blade with respect to a rotational direction of the belt; a detector for detecting the first image and the second image, at a position opposing the belt; a changing portion for changing image forming conditions of the stations on the basis of a result of detection of the detector, a controller for controlling the stations such that in a region between adjacent ones of the same images in a continuous image formations, the second image reaches the blade before the first image reaches the blade.

6 Claims, 11 Drawing Sheets

(a)

(b)

(a) COMPARISON EXAMPLE (b) EMBODIMENT 1

(a) COMPARISON EXAMPLE (b) EMBODIMENT 2

IMAGE FORMING APPARATUS

FIELD OF THE INVENTION AND RELATED ART

The present invention relates to an image forming apparatus which has an image bearing belt and a cleaning blade, and scrapes the image bearing belt with the cleaning blade to clean the image bearing belt.

There have been in wide use image forming apparatuses which form a toner image on the image bearing member of their image formation station, transfer the toner image onto a sheet of recording medium, and fix the toner image to a sheet of recording medium by applying heat and pressure to the sheet of recording medium and the toner image thereon, with the use of their fixing device. Some of them transfer the toner image directly onto a sheet of recording medium, whereas others transfer the toner image onto their intermediary transfer belt from the image bearing member, and then, onto a sheet of recording medium from the intermediary transfer belt; they indirectly transfer the toner image onto a sheet of recording medium. Further, some of them are of the so-called tandem type. That is, they have multiple image formation stations which sequentially form toner images, one for one, and sequentially transfer in layers the toner images onto their intermediary transfer belt, or a sheet of recording medium on their recording medium conveyance belt.

In the case of some image forming apparatuses in which multiple image formation stations are aligned in tandem along the image bearing belt, toner images for adjusting an image forming apparatus in settings (which are not going to be transferred onto a sheet of recording medium) are formed in the image formation stations, and are transferred onto the intermediary transfer belt.

An image forming apparatus disclosed in Japanese Laid-open Patent Application 2002-311719, which transfers a toner image for adjusting the apparatus, onto its intermediary transfer belt, is provided with a belt cleaning device having a cleaning blade, which is placed in the adjacencies of the belt.

A toner image for adjusting an image forming apparatus in settings is such a toner image that is used only for controlling the apparatus in image formation process. Thus, it is not transferred onto a sheet of recording medium, and is scraped away from the intermediary transfer belt by the cleaning blade to be recovered as waste toner.

Japanese Laid-open Patent Application 2002-311719 discloses also a toner image for rejuvenating the developer (toner) in the developing device, which is for adjusting the amount by which the developer (mixture of toner and carrier) is replenished with a fresh supply of toner, in order to keep the toner in the developer, stable in the amount of electrical charge.

Japanese Laid-open Patent Application 2005-274789 discloses a Dmax adjustment toner image, which is for adjusting an image forming apparatus in terms of the development contrast of an electrostatic latent image (which the apparatus forms) in order to keep the apparatus stable in terms of the highest level of post-fixation image density.

Further, Japanese Laid-open Patent Application 2003-345143 discloses another toner image for adjusting an image forming apparatus. This toner image is for adjusting the image forming apparatus in terms of the average length of time the toner particles in the developing device of the image forming apparatus stayed in the developing device. It forms in the pattern of a strip (toner strip), on a photosensitive drum, as the toner in the developer (made up of toner and carrier) in the developing device is discharged by a preset amount.

In a case where a cleaning blade is placed in contact with a belt (intermediary transfer belt, for example) to clean the belt, in such a manner that its cleaning edge is on the upstream side of its base portion in terms of the moving direction of the belt, increasing the contact pressure between the blade and belt increases the friction between the blade and belt, causing thereby the belt to fluctuate in its moving speed during an image forming operation. Therefore, it is desired that a toner image for supplying the cleaning edge of the cleaning blade with toner is formed and transferred onto the intermediary transfer belt, with preset intervals, to ensure that a proper amount of toner always remains across the cleaning edge of the cleaning blade.

In recent years, image forming apparatuses have been increased in the speed of their intermediary transfer belt (or recording medium conveyance belt) to increase the apparatuses in productivity. Consequently, they have increased in the amount of shock which occurs as the toner image formed on the intermediary transfer belt to control the image forming apparatus collides with the cleaning edge of the cleaning blade to be scraped away.

Thus, the changes which occurs to the amount of deformation of the cleaning blade, which occurs while an image forming apparatus is in operation, were measured with the use of a strain gauge attached to the cleaning blade. The results confirmed that the cleaning edge of the cleaning blade deforms when the control toner image is scraped away by the cleaning blade. They also confirmed that in a case where the deformation is substantial, the image forming apparatus outputs images of lower quality, which is attributable to the insufficient cleaning of the intermediary transfer belt, immediately after the occurrence of deformation to the cleaning edge of the cleaning blade.

Thus, an experiment was carried out to find out the effects of the order in which the multiple image formation stations of an image forming apparatus are made to form an adjustment toner image, amount by which toner is adhered to the intermediary transfer belt to form an adjustment toner image, type of an adjustment image, efficiency with which an adjustment toner image is transferred, and/or the like factors, upon the amount of deformation of the cleaning edge of the cleaning blade. The experiment revealed the conditions under which the cleaning edge of the cleaning blade is smaller in the amount of deformation. For example, it was confirmed that in a case where the multiple image formation stations are the same in the amount of the toner adhered to the intermediary transfer belt per unit area to form a toner strip, the amount of deformation of the cleaning edge of the cleaning blade was smallest when the most downstream image formation station was the first one to form an adjustment toner image (FIG. 4).

SUMMARY OF THE INVENTION

Thus, the primary object of the present invention is to provide an image forming apparatus which is significantly smaller in the amount of shock to which the cleaning edge of its cleaning blade is subjected when an adjustment toner image on the intermediary transferring means (belt) is scraped away by the cleaning blade of the apparatus by colliding with the cleaning blade, being therefore significantly smaller in the amount of the damage which the cleaning edge might sustain, than any image forming apparatus in accordance with the prior art.

According to an aspect of the present invention, there is provided an image forming apparatus comprising a rotatable belt member; a cleaning blade contacted to said belt member; a plurality of image forming stations including a first image forming station and a second image forming station for forming first and second adjustment toner images, respectively, on said belt member in a transfer portion, said second image forming station being disposed in a downstreammost position, and said first image forming station being disposed upstream of said second image forming station and downstream of said cleaning blade with respect to a rotational moving direction of the belt member; a detecting member for detecting the first adjustment toner image and the second adjustment toner image, at a position opposing said belt member; a changing portion for changing image forming conditions of the image forming stations on the basis of a result of detection of the detecting member, a controller for controlling said first image forming station and said second image forming station such that in a region between adjacent images in a continuous image formation, the second adjustment toner image reaches said cleaning blade before the first adjustment toner image reaches said cleaning blade.

The shock to which the cleaning edge of the cleaning blade of an image forming apparatus is subjected when an adjustment toner image is scraped away by colliding into the cleaning blade can be significantly reduced by forming a lubricational toner image before the adjustment toner image is formed, so that a toner layer is formed along the cleaning edge of the cleaning blade before the adjustment toner image collides with the cleaning edge of the cleaning blade.

As will be described later in detail, the greater the adjustment toner image in the number of the transfer stations through which it was conveyed while being subjected to compressional pressure, the greater it is in the "amount of the deformation which it causes to the cleaning edge of a cleaning blade when it is scraped away by the cleaning edge, and which is measured by a strain gauge attached to the cleaning blade". Further, the greater the adjustment toner image in the amount of bond among the toner particles in the toner image, the greater it is in the amount of deformation it causes to the cleaning edge. Further, the greater the adjustment toner image in the amount of adhesive force between an adjustment toner image and the image bearing surface of the intermediary transfer belt, the greater the amount of deformation it causes to the cleaning edge of the cleaning blade. Further, the greater the adjustment toner image in the amount per unit area by which toner was adhered to the image bearing surface of the intermediary transfer belt, the greater it is in the amount of deformation it causes to the cleaning edge of the cleaning blade. The conditions for forming a lubricational image, and the conditions for transferring the lubricational toner image, are set in consideration of the above-described discoveries.

Therefore, an image forming apparatus in accordance with the present invention is significantly smaller in the amount of shock, to which the cleaning edge of its cleaning blade is subjected when an adjustment toner image, which is substantially greater than an ordinary toner image, in the amount of shock which a cleaning blade for cleaning the intermediary transfer belt of an image forming apparatus is subjected as it encounters the toner image on the intermediary transfer belt, than any image forming apparatus in accordance with the prior art. Thus, it is significantly smaller in the amount of damage which the cleaning edge of the cleaning blade sustains as the cleaning edge encounters the adjustment toner image, than any image forming apparatus in accordance with the prior art.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, embodiments of the present invention are described in detail with reference to the appended drawings. The following embodiments of the present invention are not intended to limit the present invention in scope. That is, the present invention is applicable to any image forming apparatus, which may be partially or entirely different in structure from those in the following embodiments of the present invention, as long as it is structured so that before a toner image for adjusting the image forming apparatus (which hereafter may be referred to simply as adjustment toner image or strip) is scraped away by the cleaning blade of the image forming apparatus, a toner image which is smaller than the adjustment toner image, in the amount of the shock which the cleaning edge is subjected when the cleaning blade scrapes away the toner image on the intermediary transfer belt, is supplied to the cleaning edge of the belt cleaning blade.

That is, not only is the present invention applicable to an image forming apparatus which uses two-component developer, but also, an image forming apparatus which uses single-component developer. Further, the present invention is applicable to an image forming apparatus regardless of its type, that is, whether the image forming apparatus is of the full color or black-and-white type, single-drum or multiple-drum type, direct transfer or indirect transfer type. Further, it is applicable to an image forming apparatus regardless of the type of recording medium used by the apparatus, method for charging an image bearing component, method for exposing an image bearing member, method for transferring an image, method for fixing a toner image. In the following description of the embodiments of the present invention, only the primary sections of the image forming apparatus, which are related to the formation and transfer of a toner image, are described. However, the present invention is also applicable to various printing machines, copying machines, facsimile machines, etc., which are combinations of an image forming apparatus such as those in the following embodiments, and other devices, equipments, casings, etc. Further, it is also applicable to a multifunction apparatus, that is, an apparatus capable of performing two or more functions of the apparatuses listed above.

<Image Forming Apparatus>

Figure 1:
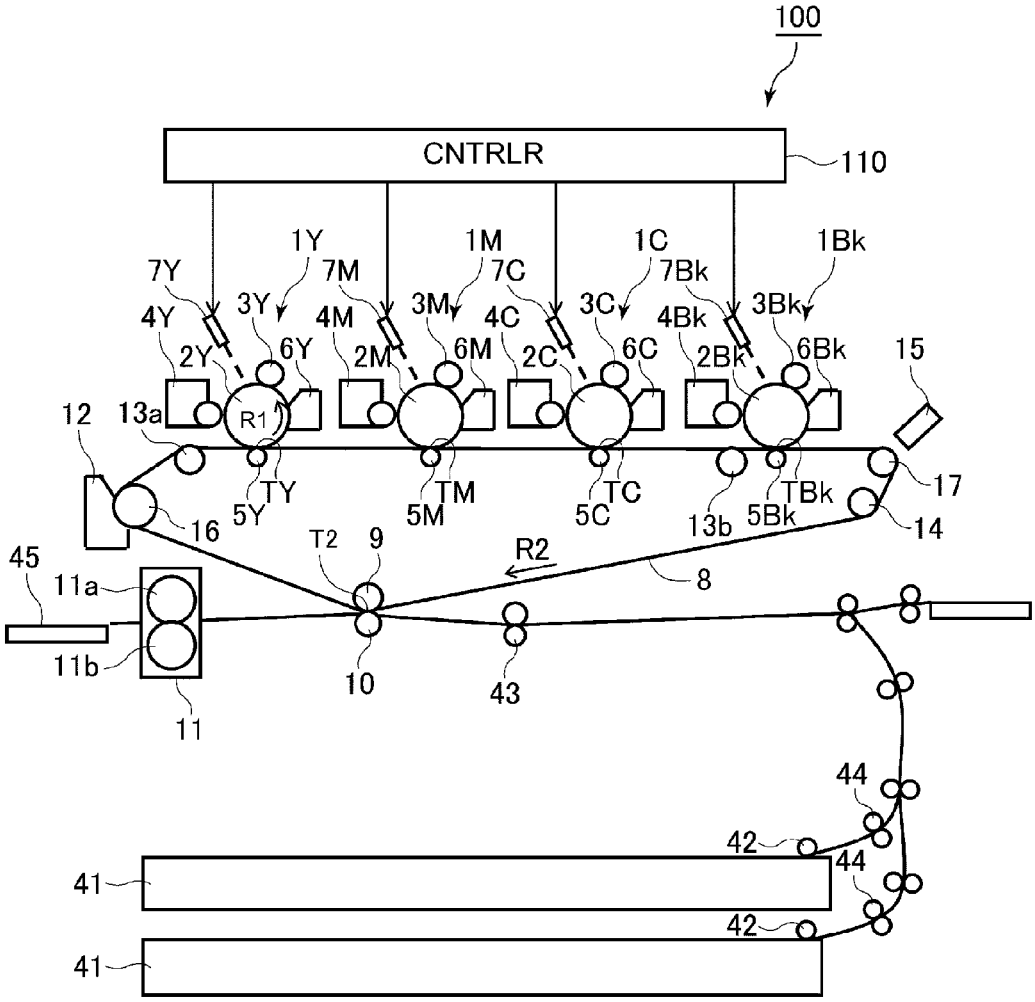
FIG. 1 is a schematic drawing of a typical image forming apparatus to which the present invention is applicable. It shows the general structure of the apparatus.
Figure 1:
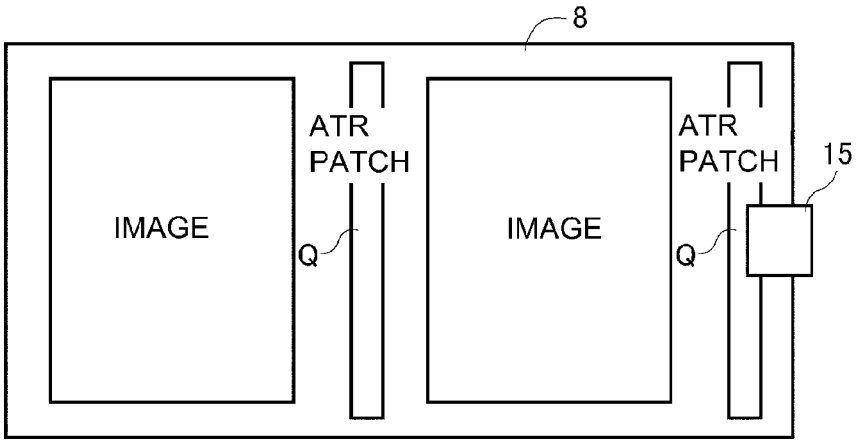

FIG. 1 is a drawing for describing a typical image forming apparatus to which the present invention is applicable. An image forming apparatus 100, shown in FIG. 1, is a full-color printer of the so-called tandem type, and also, of the indirect transfer type. Thus, it has an intermediary transfer belt 8, and four image formation stations 1Y, 1M, 1C and 1Bk which form yellow, magenta, cyan, and black monochromatic images, respectively. The four image formation stations are aligned in tandem in the adjacencies of the intermediary transfer belt 8.

In the image formation station 1Y, a yellow toner image is formed on its photosensitive drum 2Y, and is transferred onto the intermediary transfer belt 8. In the image formation station 1M, a magenta toner image is formed on its photosensitive drum 2M, and is transferred onto the intermediary transfer belt 8. In the image formation stations 1C, and 1Bk, cyan and black toner images are formed on photosensitive drums 2C and 2Bk, respectively, and are transferred onto the intermediary transfer belt 8.

After being transferred onto the intermediary transfer belt 8, the toner images, different in color, are conveyed to a secondary transfer station T2, and transferred together (secondary transfer) onto a sheet P of recording medium, in the station T2. While the toner images, different in color, are formed as described above, a sheet P of recording medium is moved out of a recording medium cassette 41 by a pickup roller 42, while being separated from the rest of the sheets P in the cassette 41. Then, it is sent to a pair of registration rollers 43, which releases the sheet P with such a timing that the sheet P arrives at the secondary transfer station T2 at the same time as the toner image on the intermediary transfer belt 8 arrives at the secondary transfer station T2. In the secondary transfer station T2, the toner images on the intermediary transfer belt 8 are transferred onto the sheet P. After the transfer of the toner images onto the sheet P, the sheet P is sent to the fixing device 11, in which the toner images on the sheet P are fixed to the sheet P by the heat and pressure applied to the sheet P and the toner images thereon, by the fixing device 11. Then, the sheet P is discharged into a delivery tray 45 of the image forming apparatus 100.

The image formation stations 1Y, 1M, 1C and 1Bk are roughly the same in structure, although they are different in the color of the toner which their developing devices 4Y, 4M, 4C and 4Bk use. Hereafter, therefore, only the image formation station 1Y is described, since the image formation stations 1M, 1C and 1Bk are the same in description except for the suffix (M, C or Bk) of their referential codes.

The image formation station 1Y has the photosensitive drum 2Y, and means for processing the photosensitive drum 2Y, which are charging roller 3Y, exposing device 7Y, developing device 4Y, primary transfer roller 5Y, and drum cleaning device 6Y, which are in the adjacencies of the peripheral surface of the photosensitive drum 2Y. The photosensitive drum 2Y is made up of an aluminum cylinder, and a negatively chargeable photosensitive layer formed on the peripheral surface of the aluminum cylinder. It is rotatable at a preset process speed in the direction indicated by an arrow mark R1 in FIG. 1. As an alternating voltage, which is a combination of a DC voltage VD and an AC voltage, is applied to the charge roller 3Y, the charge roller 3Y uniformly charges the peripheral surface of the photosensitive drum 2Y to a preset level VD of negative polarity, which will be the potential level of unexposed points of the peripheral surface of the photosensitive drum 2Y.

As image formation signals (image data) are inputted into the image forming apparatus 100 from an external apparatus (personal computer, for example), the image formation signal processing section of the image forming apparatus 100 turns the image data into digital data with which the beam of laser light is modulated as it is emitted by the exposing device 7Y to form the yellow (magenta, cyan, or black) monochromatic toner image. The exposing device 7Y writes an electrostatic image of the yellow monochromatic image on the peripheral surface of the photosensitive drum 2Y by scanning the uniformly charged portion of the peripheral surface of the photosensitive drum 2Y with the beam of laser light which it emits while modulating the beam of laser light with the digital image formation data, and deflecting it with its rotational mirror. The developing device 4Y develops the electrostatic image on the peripheral surface of the photosensitive drum 2Y into a visible image, that is, an image formed of yellow toner, by causing the toner to transfer onto the peripheral surface of the photosensitive drum 2Y, in the pattern of the electrostatic image thereon.

The primary transfer roller 5Y is kept pressed upon the inward surface of the intermediary transfer belt 8, forming thereby the primary transfer station TY between the peripheral surface of the photosensitive drum 2Y and intermediary transfer belt 8. As positive DC voltage is applied to the primary transfer roller 5Y, the toner image on the photosensitive drum 2Y, which is negative in polarity, is transferred onto the intermediary transfer belt 8 (primary transfer). The drum cleaning device 6Y recovers the transfer residual toner, that is, the toner which failed to be transferred from the photosensitive drum 2Y onto the intermediary transfer belt 8, and therefore remaining on the peripheral surface of the photosensitive drum 2Y after the primary transfer of the toner image.

The intermediary transfer belt 8 is supported by a belt driving roller 14, a belt tensioning roller 16, a belt backing roller 9, and a idler roller 17, in such a manner that it extends between the driving roller 14 and belt backing roller 9, between the belt tensioning roller and 16 and roller 13*a*, between the roller 13*a* and an idler roller 17, and between the idler roller 17 and belt driving roller 14. It circularly moves in the direction indicated by an arrow mark R2 by being driven by the belt driving roller 14. The image forming apparatus 100 is provided with an optical sensor 15, which is positioned so that it faces the portion of the outward surface of the intermediary transfer belt 8, which corresponds in position to the idler roller 17. The optical sensor 15 outputs a voltage (signal), the amplitude of which is proportional to the amount by which toner is adhered, per unit area, to the intermediary transfer belt 8 to form a toner image (adjustment toner image) for adjusting the image forming apparatus 100. More specifically, it projects a beam of infrared light upon the adjustment toner image, which was formed on the photosensitive drum 2Y and transferred onto the intermediary transfer belt 8 from the photosensitive drum 2Y, and detects the portion of the beam reflected by the adjustment toner image on the intermediary transfer belt 8. Then, it outputs voltage, the magnitude of which is proportional to the amount by which toner was adhered, per unit area, to the intermediary transfer belt 8.

The fixing device 11 has a heat roller 11*a* and a pressure roller 11*b*, which are heated by their internal heater. The heat roller 11 and pressure roller 11*b* form a heating nip by being kept pressed upon each other. As a sheet P of recording medium, on which unfixed toners are present, is conveyed through the heating nip, the toner images come into contact with the heat roller 11*a*, being thereby melted. Then, as the sheet P is moved out of the heating nip, the melted toner images solidify while adhering to the surface of the sheet P; the toner images become fixed to the sheet P.

<Belt Cleaning Device>

Figure 2:
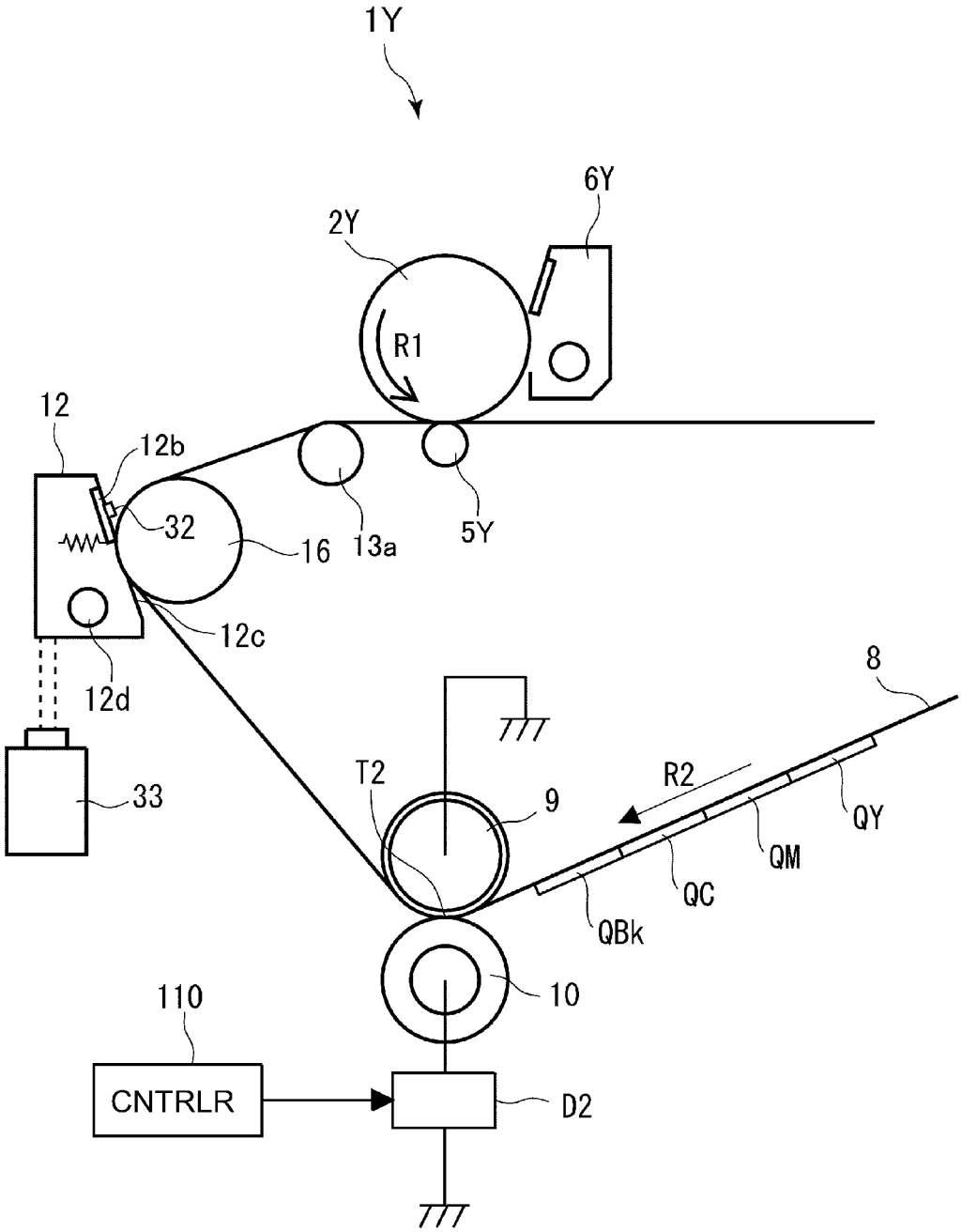
FIG. 2 is a schematic sectional view of the belt cleaning device of the image forming apparatus shown in FIG. 1. It shows the structure of the device.

FIG. 2 is a drawing for describing the structure of the belt cleaning device 12 of the image forming apparatus 100. As will be evident from FIG. 2, the image forming apparatus 100 is provided with the belt cleaning device 12, which is for removing the toner, paper dust, and the like contaminants remaining on the surface of the intermediary transfer belt 8 after the transfer of the toner images from the intermediary transfer belt 8 onto the sheet P of recording medium. The belt cleaning device 12 in this embodiment is of the blade type; it has a cleaning blade 12*b* which is placed in contact with the intermediary transfer belt 8 to scrape the intermediary transfer belt 8 to remove the contaminants such as the residual toner, paper dust, etc., from the intermediary transfer belt 8.

The belt cleaning device 12 has also a scooping sheet 12*c* and a screw 12*d*. As the intermediary transfer belt 8 is circularly moved, the intermediary transfer belt 8 is scraped by the cleaning edge of the cleaning blade 12*b*, which is kept in contact with the portion of the intermediary transfer belt 8, by which the intermediary transfer belt 8 is supported by the belt tensioning roller 16. Thus, the transfer residual toner, paper dust, and the like contaminants, are scraped away from the intermediary transfer belt 8 by the cleaning edge of the cleaning blade 12*b*, scooped up by the scooping sheet 12*c*, and delivered to the screw 12*d*, which delivers the recovered transfer residual toner, and the like, to a waste toner container 33, which is on the front side of the image forming apparatus 100, and in which the waste toner and the like are to be stored.

The cleaning blade 12*b* is kept in contact with the intermediary transfer belt 8, with a pair of springs, in such an attitude that it is tilted in the opposite direction from the moving direction of the intermediary transfer belt 8, and also, that the angle of its contact relative to the intermediary transfer belt 8 becomes 17 degrees. It is made of urethane rubber, and is 1-2 mm in thickness.

The scooping sheet 12*c* is made of polyethylene-terephthalate, and is 20-50 μm in thickness. It is for preventing the problem that as the transfer residual toner is scraped away from the intermediary transfer belt 8, it temporarily accumulates along the cleaning edge of the cleaning blade 12*b*, lumps, and falls. It is kept in contact with the intermediary transfer belt 8 in such an attitude that it is tilted in the same direction as the moving direction of the intermediary transfer belt 8, with its scooping edge being in contact with the intermediary transfer belt 8.

<Toner Image for Adjusting Image Forming Apparatus>

An example of toner image for adjusting an image forming apparatus is a toner strip formed for automatically rejuvenating the developer in the developing device. That is, in order to keep the developer in the developing device stable in the amount of toner charge at a preset level to ensure that the amount by which toner is adhered to the electrostatic image on the photosensitive drum per unit area to developer the electrostatic image remains stable at a preset level, the amount by which the developing device is replenished with toner is adjusted. More specifically, the developing device 4Y negatively charges the toner in the developer (combination of toner and carrier) in the developer container, by circulating the developer in the developer container while stirring the developer. The developing device 4Y develops the electrostatic image on the photosensitive drum 2Y by transferring the negatively charged toner onto the peripheral surface of the photosensitive drum 2Y. That is, the developer in the developer container is borne on the peripheral surface of the development roller, and made to crest to form a "magnetic brush" which rubs the peripheral surface of the photosensitive drum 2Y. Further, the alternating voltage, which is a combination of a DC voltage and an AC voltage, is applied to the development sleeve. Thus, only the negatively charged toner particles in the developer are transferred onto the peripheral surface of the photosensitive drum 2Y in the pattern of the electrostatic latent image on the peripheral surface of the photosensitive drum 2Y. Thus, in order to compensate for the toner consumed for image formation, the developing device 4Y is automatically replenished with a fresh supply of toner (ATR Adjustment Control).

Referring to FIG. 1(*b*), in the ATR control, an electrostatic image which is preset in development contrast (50% in gradation scale) is formed on the peripheral surface of the photosensitive drum 2Y, and is developed by the developing device 4Y into a toner image Q, or the ATR adjustment toner image.

More specifically, the ATR adjustment toner image Q is formed through the following steps. Referring to FIG. 1, in a case where a potential level sensor is not on the photosensitive drum 2Y, it is impossible to vary the photosensitive drum 2Y in the amount of surface potential in order to measure the amount by which toner is adhered, per unit area, to the peripheral surface of the photosensitive drum 2Y. In this embodiment, therefore, the ATR adjustment toner image Q is formed in an analog fashion, that is, without exposing the peripheral surface of the photosensitive drum 2Y with the exposing device 7Y.

The development contrast of the ATR adjustment toner image Q is the difference in the amount of potential between the potential level of a given point of the electrostatic image, to which toner is to be adhered, and the potential level of the DC voltage applied to the development sleeve. It is proportional to the amount of electricity, per unit area, of the peripheral surface of the photosensitive drum 2Y, which is to be cancelled by the electrical charge of the toner. Thus, the ATR adjustment toner image Q is formed in the shape of a long and narrow strip, the length of which in terms of the widthwise direction of the intermediary transfer belt 8, that is, the direction perpendicular to the moving direction of the intermediary transfer belt 8, is equal to the widest electrostatic image which can be formed on the peripheral surface of the photosensitive drum 2Y and can be developed by the developing device 4Y.

After the formation of four ATR adjustment toner images Q in the four image formation stations 1Y, 1M, 1C, and 1Bk, one for one, the four ATR adjustment toner images Q are transferred onto the intermediary transfer belt 8. Then, the amount by which toner was adhered to the peripheral surface of the each photosensitive drum 2 (2Y, 2M, 2C and Bk) to form each ATR adjustment toner image, is detected by the optical sensor 15. Then, all the ATR adjustment toner images are conveyed to the belt cleaning device 12, and are recovered by the device 12.

Another example of the toner image for adjusting an image forming apparatus is a roughly square toner image formed as an image for adjusting the image forming apparatus 100 in Dmax. An operation for controlling the image forming apparatus 100 in Dmax is such an operation that adjusts an image forming apparatus in development contrast to ensure that the highest density of an image which will be outputted by the apparatus will be at the preset level. In the case of the image forming apparatus 100, the frequency with which the image forming apparatus 100 is controlled in Dmax is less than the frequency with which the image forming apparatus 100 is controlled in ATR amount. In Dmax control, multiple Dmax adjustment toner images, which are 100% in gradation scale, are formed with the development contrast set at various levels. The four Dmax adjustment toner images formed in the four image formation stations 1Y, 1M, 1C and 1Bk, one for one, are transferred onto the intermediary transfer belt 8, and the amount of the toner per unit area of each toner image is detected by the optical sensor 15. Then, the four Dmax adjustment toner images are conveyed to the belt cleaning device 12 and are recovered by the device 12.

Another example of the toner image for adjusting an image forming apparatus is a toner strip which is formed to prevent the problem that the developer in the developing device degrades in terms of chargeability. As the toner particles in the developing device 4Y increase in the average length of time they were stirred, they degrade in various properties. Therefore, as a substantial number of images which are low in toner consumption (greater in amount of area which is not covered with toner) are continuously formed, the control section 110 forms a toner "strip" on the peripheral surface of the photosensitive drum 2Y to cause the developing device 4Y to discharge a preset amount of toner.

More specifically, in order to cause the developing device 4Y to discharge a preset amount of toner, the image forming apparatus 100 is controlled as follows: The control section 110 calculates the amount of toner consumption per sheet of recording medium for each color (each image formation station), and calculates the amount of difference between the amount of toner consumption and a preset threshold value. Further, the control section 110 calculates the cumulative amount of the difference between the toner consumption and the preset threshold value while a preset number of images are formed. Then, it decides whether the cumulative amount has reached a preset value. If it decides that the cumulative amount has reached the preset value, it causes the developing device 4Y to discharge the preset amount of toner onto the photosensitive drum 2Y.

If the control section 110 determines that all the image formation stations (developing devices 4Y, 4M, 4C and 4Bk) have been small in the amount of toner consumed for image formation, that is, are large in the amount of difference between the amount of toner consumption and the preset threshold value, the control section 110 causes all the developing devices 4 to discharge the preset amount of toner. In comparison, if the control section 110 determines that only black toner has been used for image formation, it causes the developing devices 4Y, 4M and 4C to discharge the preset amount of toner. Further, if the control section 110 determines that only three color toners (Y, M and Bk toners) have been used, it causes only the developing device 4C to discharge the preset amount of toner.

In other words, the toner in each developing device 4, which has degraded in terms of chargeability, is removed from the developing device 4, by the preset amount through the above described process. Thus, the developing device 4 is replenished with fresh toner by the preset amount. Therefore, the developing device 4 is prevented from becoming excessive in the average length of time toner particles remain therein.

To describe in detail the process for causing the developing device 4 to discharge the preset amount of toner, the DC voltage to be applied to the charge roller 3Y is temporarily reduced in magnitude to form an electrostatic image on the peripheral surface of the photosensitive drum 2 without exposing the peripheral surface of the photosensitive drum 2. Then, the thus formed electrostatic image is developed to form a "toner strip". The four toner "strips" formed in the four image formation stations 1Y, 1M, 1C and 1Bk, one for one, are transferred onto the intermediary transfer belt 8, conveyed to the belt cleaning device 12, and recovered by the device 12.

The photosensitive drums 2Y, 2M, 2C and 2Bk of the image forming apparatus 100 are small in diameter (30 mm). Therefore, it is virtually impossible to place the optical sensor 15 in the immediate adjacencies of the photosensitive drums 2. Further, even if it is possible to place the optical sensor 15 in the adjacencies of the photosensitive drums 2, placing the optical sensor 15 in the adjacencies of each photosensitive drum 2 requires four optical sensors 15. Thus, the ATR adjustment toner images (or Dmax adjustment toner images) formed on the photosensitive drums 2Y, 2M, 2C and 2Bk, one for one, are transferred onto the intermediary transfer belt 8 (primary transfer), and then, the optical sensor 15, positioned in the adjacencies of the image bearing surface of the intermediary transfer belt 8, is used to detect the amount of the toner which each ATR adjustment toner images (or Dmax adjustment toner images) on the intermediary transfer belt 8 has per unit area. These adjustment toner images are made to move through the secondary transfer station T2, by the application of negative voltage to the secondary transfer roller 10. Then, they are recovered by the cleaning device 12.

It is possible to transfer the toner images for adjusting an image forming apparatus (which hereafter may be referred to simply as adjustment toner image or strip) back onto the photosensitive drum 2Y from the intermediary transfer belt 8, by circularly moving the intermediary transfer belt 8 one full turn while applying negative voltage to the primary transfer roller 5Y, so that they can be recovered by the drum cleaning device 6Y. In principle, as long as negative voltage is applied to the primary transfer roller 5Y, the adjustment toner images can be recovered by the drum cleaning device 6Y without transferring them onto the intermediary transfer belt 8. However, as the photosensitive drums 2Y, 2M, 2C and 2Bk were reduced in size, the drum cleaning devices 6Y, 6M, 6C and 6Bk also were reduced in size. Therefore, the drum cleaning devices 6Y, 6M, 6C and 6Bk have no room for recovering the adjustment toner images.

<Amount of Load to which Cleaning Blade is Subjected when Cleaning Blade Scrapes Away Adjustment Toner Image>

Referring to FIG. 2, the amount of the toner on the portion of the intermediary transfer belt 8 which is on the immediately downstream side of the secondary transfer station T2, that is, the amount of residual toner on the intermediary transfer belt 8, is substantially smaller than the amount of the toner on the portion of the peripheral surface of the photosensitive drum 2 which is on the immediately downstream side of the primary transfer station TY. Thus, the amount by which the transfer residual toner traceable to the normal image is scraped away from the intermediary transfer belt 8 by the cleaning device 12 is very small. Therefore, the transfer residual toner on the intermediary transfer belt 8 can be satisfactorily removed by the belt cleaning device 12, even if the contact pressure between the cleaning edge of the cleaning blade 12*b* and intermediary transfer belt 8 is very small.

In the case of the adjustment toner images, they are not transferred onto a sheet of recording medium. That is, they reach the belt cleaning device 12 in entirety. Therefore, the cleaning device 12 has to recover a large amount of toner. In other words, in the operation for adjusting (correcting) the image forming apparatus 100, the adjustment toner images, which are greater in the amount of toner per unit area (higher in image density), are formed (transferred) onto the intermediary transfer belt 8. Therefore, it is more likely for the cleaning blade 12*b* to be required to recover a large amount of toner than in the normal image forming operation. In other words, in the operation for adjusting the image forming apparatus 100, it is more likely for the cleaning edge of the cleaning blade 12*b* to become damaged than in the normal image forming operation. Once the cleaning edge of the cleaning blade 12*b* is damaged, the cleaning device 12 is likely to fail to properly clean the intermediary transfer belt 8, and therefore, the image forming apparatus 100 is likely to reduce in image quality. As a part or parts of the cleaning edge portion of the cleaning blade 12 are made to buckle downstream in terms of the moving direction of the intermediary transfer belt 8, being therefore pulled (folded back) into the nip between the cleaning edge and intermediary transfer belt 8, by the toner images on the intermediary transfer belt 8, it becomes easier for toner particles to slip through the portions of the nip, which correspond to the buckled portions of the cleaning edge.

Some adjustment toner images slip through the nip between the cleaning edge of the cleaning blade 12 and intermediary transfer belt 8 by slipping into the underside of the cleaning edge of the cleaning blade 12*d*, and pushing up the cleaning edge, which results in the unsatisfactory cleaning of the intermediary transfer belt 8. The amount of the force which an adjustment toner image applies upward to the cleaning blade 12*b* is affected by the amount by which toner is recovered by the cleaning device 12, and/or the amount of adhesive force between the intermediary transfer belt 8 and the toner thereon.

The image forming apparatus 100 has the image formation stations 1Y, 1M, 1C and 1Bk, which are aligned in tandem along the intermediary transfer belt 8. Therefore, an adjustment toner image formed in the image formation station 1Y, that is, the most upstream one in terms of the moving direction of the intermediary transfer belt 8, is moved through the primary transfer stations TM, TC and TBk as well as the primary transfer station TY. Further, each time the adjustment toner image formed in the image formation station 1Y is moved through a primary transfer station T, the mechanical adhesion between the adjustment toner image and intermediary transfer belt 8 increases in strength. Therefore, the adjustment toner image (which is greater in amount of toner per unit area), which is formed in the image formation station 1Y, that is, the most upstream station, sometimes becomes a serious amount of load to the cleaning blade 12*b*, which is large enough to cause the cleaning blade 12*b* to unsatisfactorily clean the intermediary transfer belt 8.

<Device for Evaluating Cleaning Blade Deformation>

Figure 3:
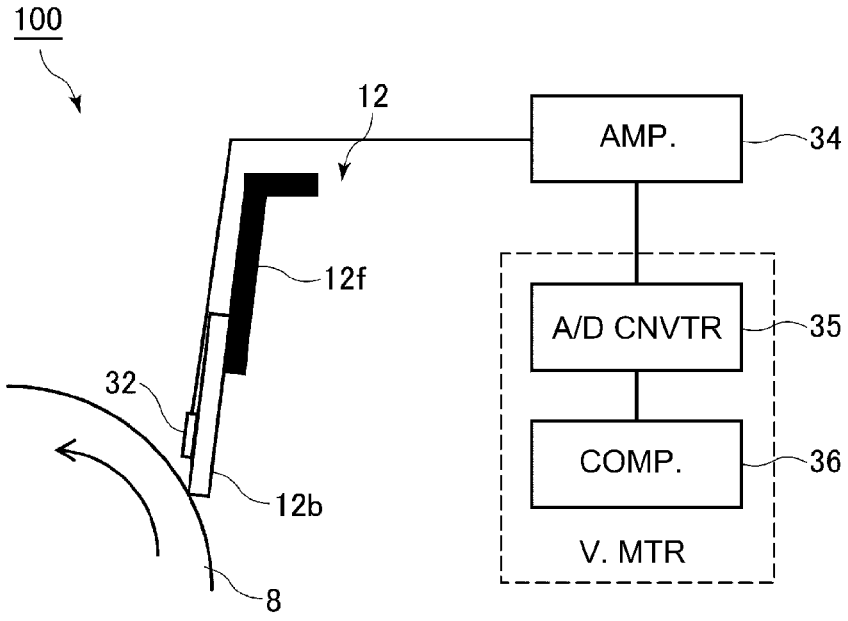
FIG. 3 is a drawing for describing the device of the image forming apparatus shown in FIG. 1, which is for evaluating the amount of the deformation of the cleaning blade.

FIG. 3 is a drawing of the device for evaluating the deformation of the cleaning blade 12*b*. As is evident from FIG. 3, the amount of deformation of the cleaning blade 12*b* was measured by a strain gauge 32 (product of Kyowa Co., Ltd.) adhered to the rear surface (outward surface) of the cleaning blade 12*b*. The strain gauge 32 is made to deform by the expansion and contraction of the surface of the cleaning blade 12*b*. As it deforms, it changes in the amount of electrical resistance. A signal amplifier 34 detects the output voltage of the strain gauge 32 by flowing a preset amount of electrical current through the gauge 32, and amplifies the output voltage. An A/D converter 35 converts the amplified analog signal into digital signal. A personal computer 36 functions as a voltmeter, and outputs the amount of the deformation of the strain gauge 32, with preset intervals which are synchronized with the circular movement of the intermediary transfer belt 8.

Experiment 1

Figure 4:
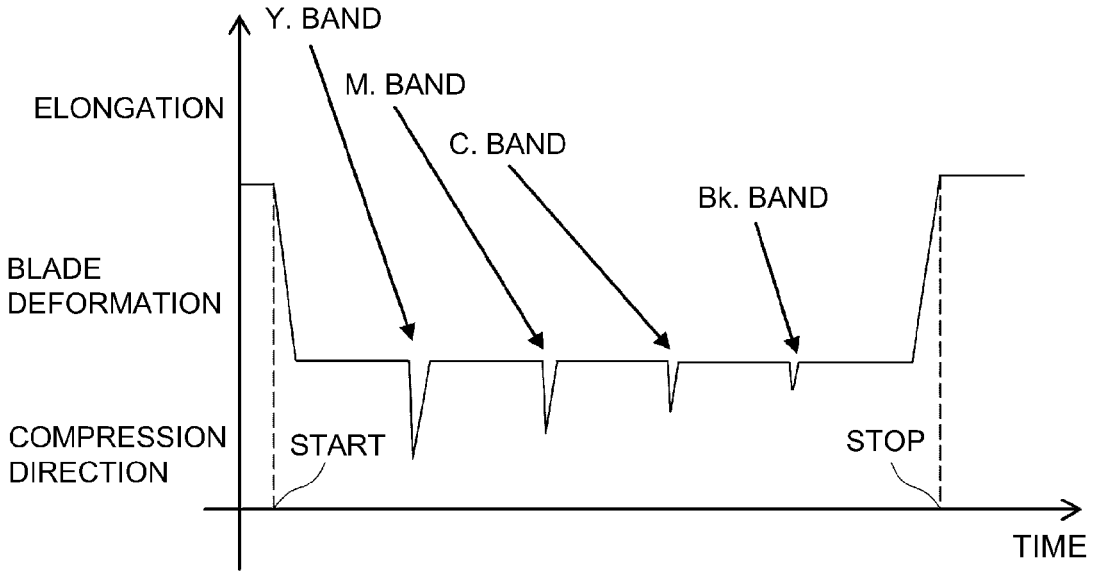
FIG. 4 is a drawing for describing the relationship between the color of an adjustment toner image (strip) and the amount of the deformation which the toner image (strip) causes to the cleaning blade.

FIG. 4 is a drawing for describing the relationship between the color of a toner strip and the amount of the deformation of the cleaning blade 12*b*. In this experiment, a substantial number of prints are continuously formed with the use of the image forming apparatus 100 shown in FIG. 1. During the image forming operation, the image formation stations 1Y, 1M, 1C and 1Bk were made to output a toner strip with different timings for every 100 prints, and the toner strips were transferred onto the intermediary transfer belt 8 (primary transfer). Then, each toner strip was moved through the secondary transfer station T2 while negative voltage was applied to the secondary transfer roller 10. Then, each toner strip was recovered by the cleaning device 12.

The electrostatic image for each toner strip was formed without using the exposing devices 7Y, 7M, 7C and 7Bk. More specifically, an electrostatic image, the dimension of which in terms of the widthwise direction of the intermediary transfer belt 8 is equal to charging range of the charge roller 3 in its lengthwise direction, is formed on the photosensitive drum 2, by keeping the DC voltage VD of the alternating voltage which is to be applied to the charge rollers 3Y, 3M, 3C and 3Bk, lower than the normal voltage, for a length of time which is equivalent to the dimension of the toner strip in the moving direction of the intermediary transfer belt 8. By reducing the DC voltage VD from −600 V to −200 V, +400 V of development contrast was realized between the potential level of the peripheral surface of the photosensitive drum 2 and the AC voltage Vdc of the alternating voltage applied to the development sleeve of the developing device 4, whereby the electrostatic image was developed into a toner strip, the amount of the toner of which per unit area is equivalent to the post-fixation reflection density of 1.0.

Referring to FIG. 4, as the intermediary transfer belt 8 begins to be circularly moved, the cleaning blade 12*b* is made to deform by the pressure applied thereto by the intermediary transfer belt 8. Then, each time a toner strip, which is yellow, magenta, cyan, or black toner strip, reaches the cleaning blade 12*b*, the cleaning blade 12*b* increased in the amount of the deformation attributable to the toner strip. Further, the amount of the deformation of the cleaning blade 12*b* was significantly affected by in which image formation station the toner strip was formed.

The yellow toner strip, which is formed in the image formation station 1Y, that is, the most upstream image formation station in terms of the moving direction of the intermediary transfer belt 8 was the largest in the amount by which the cleaning blade 12*b* was deformed by the toner strip, whereas the black toner strip, which was formed in the image formation station 1Bk, that is, the most downstream one in terms of the moving direction of the intermediary transfer belt 8, was smallest in the amount of the deformation of the cleaning blade 12, for the following reason.

Each time an adjustment toner strip is moved through the primary transfer station T (TY, TM, TC or TBk), in which the toner strip is pressed upon the intermediary transfer belt 8 by the primary transfer roller 5 (5Y, 5M, 5C or 5Bk), the toner strip is increased in its adhesive strength to the intermediary transfer belt 8. The greater a toner strip in the adhesive strength to the intermediary transfer belt 8, the more resistant it is to the impact which occurs as it collides with the cleaning edge of the cleaning blade 12*b*, and the greater it is in the amount of force necessary to be applied thereto to scrape it away from the intermediary transfer belt 8. Therefore, if two toner strips are equal in the amount of toner per unit area thereof, the toner strip which is greater in the number of times it was moved through the primary transfer station T (TY, TM, TC and TBk), that is, the interface between the photosensitive drum 2 and intermediary transfer belt 8, is greater in the amount of damage to the cleaning blade 12*b*.

When a certain amount of toner is staying at the cleaning edge of the cleaning blade 12*b*, the friction between the intermediary transfer belt 8 and cleaning blade 12*b* remains relatively low. Thus, the amount of friction which the cleaning blade encounters as it scrapes away the toner strip is substantially smaller than when no toner is staying at the cleaning edge of the cleaning blade 12*b*. That is, the toner particles staying along the cleaning edge of the cleaning blade 12*b* function as lubricant, which reduces the impact which will occur as the toner strip collides with the cleaning edge.

Embodiment 1

Figure 5:
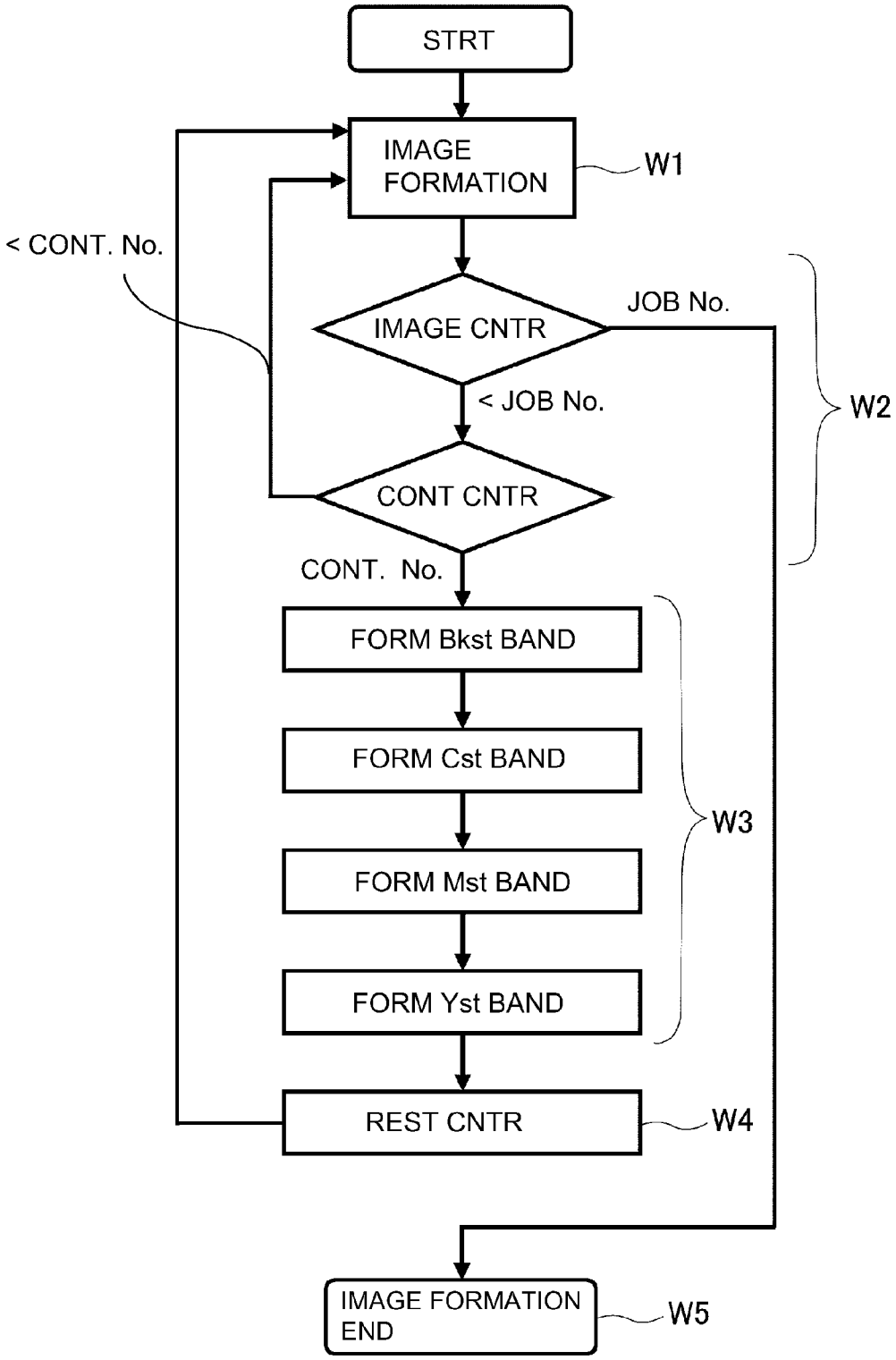
FIG. 5 is a flowchart of the operational sequence of the image forming apparatus in the first embodiment, for forming toner strips for adjusting the image forming apparatus.

FIG. 5 is a flowchart of the operational sequence for outputting adjustment toner strips, in the first embodiment. In the first embodiment, in order to minimize the amount of the load to which the cleaning blade 12*b* is subjected, the image forming apparatus 100 is operated to arrange the four adjustment toner strips, different in color, on the intermediary transfer belt 8, based on the results of the first experiment, so that the four toner strips reach the cleaning blade in the order of the least damage to the cleaning edge of the cleaning blade 12*b*.

Referring to FIG. 1, the image formation stations 1Y, 1M, 1C and 1Bk form four toner strips (examples of adjustment toner images, which are as wide as development range in terms of widthwise direction of intermediary transfer belt 8), one for one, and transfers the four toner strips onto the intermediary transfer belt 8 (example of intermediary transfer medium) while applying pressure to the four toner images. The cleaning blade 12*b* is kept pressed upon the intermediary transfer belt 8, and recovers the four ATR adjustment toner images as the four images are conveyed by the intermediary transfer belt 8. The control section 110 (example of controlling means) controls the image formation stations 1Y, 1M, 1C, and 1Bk in such a manner that the cleaning blade 12*b* is supplied with a lubricational toner image before the first ATR adjustment toner image arrives at the cleaning blade 12*b*. The lubricational toner image is the toner strip QBk formed in the image formation station 1Bk, and is delivered to the cleaning blade 12*b* before the toner strips QY, QM and QC formed in the image formation stations 1Y, 1M and 1C, respectively, sequentially arrive at the cleaning blade 12*b*. More specifically, the control section 110 controls the exposing devices 7Y, 7M, 7C and 7Bk in the image formation timing in order to position the four toner strips in the above described order on the intermediary transfer belt 8.

Next, referring to FIG. 4, in terms of the amount of the deformation of the cleaning edge of the cleaning blade 12*b* which a toner image on the intermediary transfer belt 8 causes as it is scraped away by the cleaning blade 12, the toner strip QBk, which is an example of lubricational toner image, is smaller than any of the ATR adjustment toner images. The amount of the deformation which a toner image on the intermediary transfer belt 8 causes to the cleaning edge of the cleaning blade 12*b* as the toner image is scraped away by the cleaning blade 12 can be measured by solidly attaching the strain gauge 32 to the cleaning blade 12*b* as shown in FIG. 3.

Referring to FIG. 5 along with FIG. 1, as the control section 110 receives an image formation job, it makes the image forming apparatus 100 begin an image forming operation, and begins to count the number of prints formed (W1). As the print count reaches the print count value of the job (value in image formation counter in W2), the control section 110 ends the image forming operation (W5). Each time the print count reaches the preset value (value in counter in W2), the control section 110 makes the image forming apparatus 100 form four toner strips on photosensitive drums 2Y, 2M, 2C and 2Bk, one for one, and transfer the toner strips onto the intermediary transfer belt 8. In this embodiment, the preset value in the counter in W2 is 100. The toner strips are conveyed to the belt cleaning device 12, scraped away from the intermediary transfer belt 8 by the cleaning blade 12*b* of the cleaning device 12, and recovered by the cleaning device 12 (W3). More concretely, referring to FIG. 2, the timing with which the writing of an electrostatic latent image is started on the photosensitive drums 2Y, 2M, 2C and 2Bk, and ended, are set so that the black, cyan, magenta, and yellow toner strips QBk, QC, QM and QY are transferred onto the intermediary transfer belt 8, with no gap among them, in the listed order, black QBk being the first one in terms of the moving direction of the intermediary transfer belt 8. In terms of the moving direction of the intermediary transfer belt 8, the four toner strips are sequentially transferred onto the intermediary transfer belt 8 (primary transfer), starting from the most downstream image formation station 1. That is, the four image formation stations sequentially are made to form four toner strips, different in color, one for one, starting from the black image forming station 1Bk, that is, the most downstream one.

With the image forming apparatus 100 being controlled by the control section 110 as described above, the toner strip which is the least adhesive to the intermediary transfer belt 8 is the first one to be delivered to the cleaning blade 12*b*, and forms a toner layer along the cleaning edge of the cleaning blade 12*b*, minimizing thereby the amount of load to which the cleaning blade 12*b* will be subjected when the subsequent toner strips (ATR adjustment toner images), which are substantially more adhesive to the intermediary transfer belt 8 than the lubricational toner strip, are scraped away by the cleaning blade 12*b*.

In the first embodiment, the four toner strips, different in color, are sequentially formed, starting in the black toner image formation station 1Bk, that is, the most downstream one in terms of the moving direction of the intermediary transfer belt 8. Therefore, a toner layer, which functions as lubricant, is formed along the cleaning edge of the cleaning blade 12*b*, without subjecting the cleaning edge of the cleaning blade 12*b* to a significant amount of load. Therefore, the image forming apparatus 100 is minimized in the amount of the load to which the cleaning blade 12*b* is subjected when the ATR adjustment toner images are scraped away from the intermediary transfer belt 8 by the cleaning blade 12*b*. Therefore, it is unlikely for the cleaning blade 12*b* to fail to satisfactorily clean the intermediary transfer belt 8.

The modified version of the second embodiment, which will be described later, is an example of the embodiment of the present invention, which was realized in anticipation of "toner discharge+Dmax control" and "toner discharge+ATR control". Another modified version of the second embodiment is realized in anticipation of "lubricational toner image+Dmax control" and "lubricational toner image+ATR control". In comparison to these embodiments and their modifications, in the first embodiment, the black toner strip or black toner patch, which is smallest in the amount of the load to which the cleaning blade 12*b* is subjected when the cleaning blade 12*b* scrapes away a toner image on the intermediary transfer belt 8, is used as the lubricational toner image for lubricating the cleaning edge of the cleaning blade 12*b* before the toner strips or patches, which are different in color from the black toner strips or patches, are formed.

<Comparative Image Forming Apparatus 1>

Figure 6:
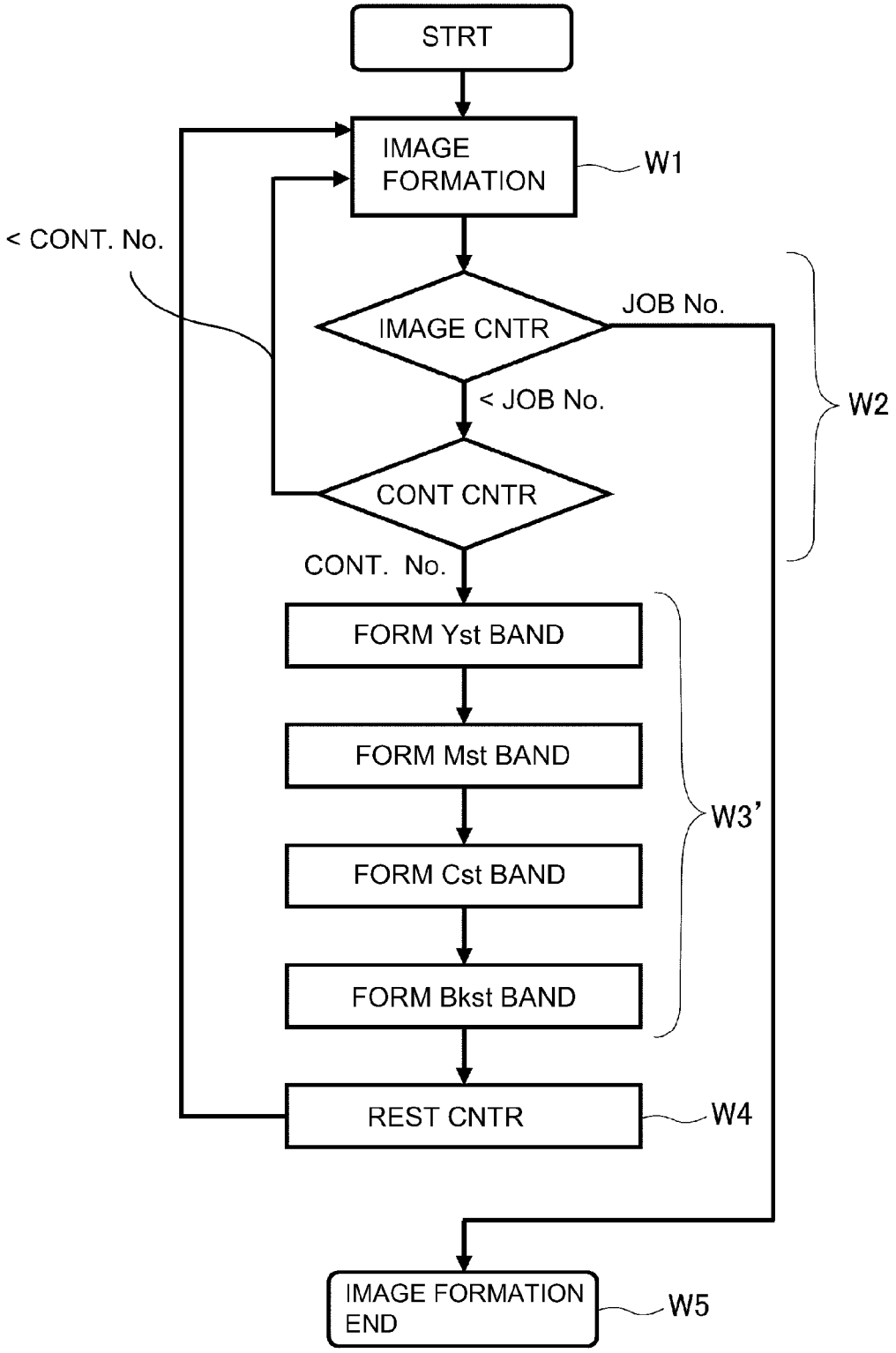
FIG. 6 is a flowchart of the operational sequence of the first comparative image forming apparatus, for forming toner strips for adjusting the image forming apparatus.
Figure 7:
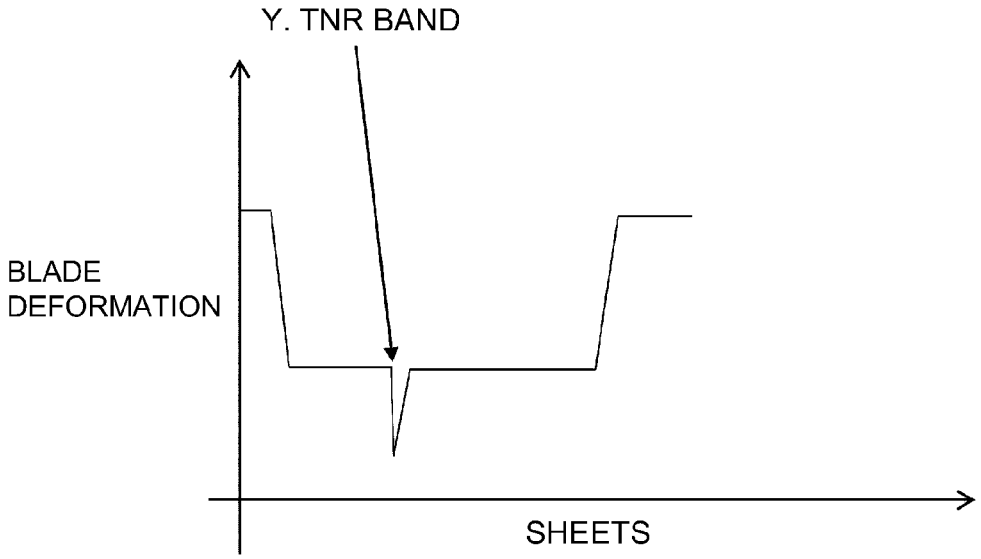
FIG. 7 is a graph which shows the effects of the first embodiment of the present invention.
Figure 7:
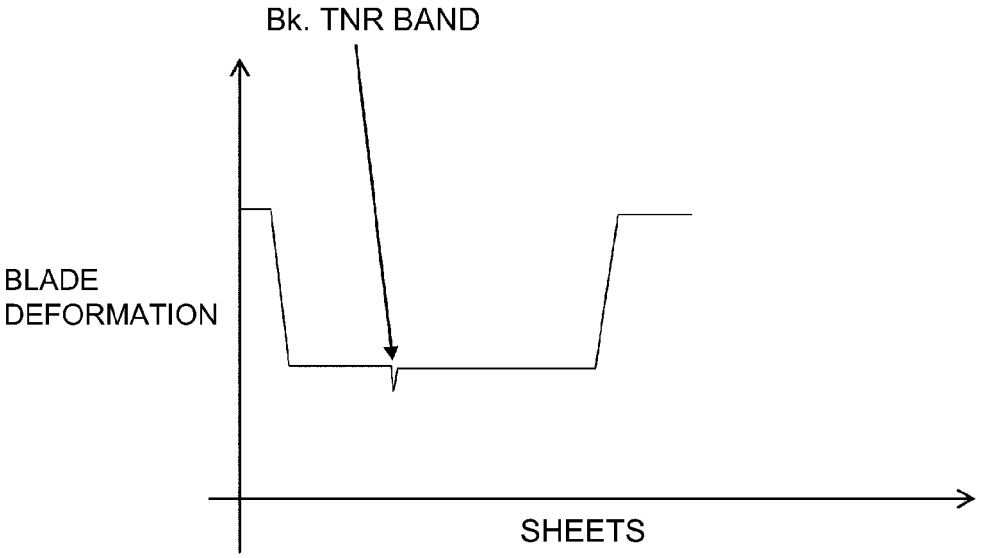

FIG. 6 is a flowchart of the operational sequence of the first of the comparative image forming apparatuses, for forming toner strips. FIG. 7 is a drawing for describing the effects of the first embodiment of the present invention.

In the case of the first example of comparative image forming apparatus, the image forming apparatus is controlled so that the four toner strips are arranged on the intermediary transfer belt 8 in the reverse order to the one in the first embodiment. The first example of comparative image forming apparatus is different from the image forming apparatus 100 in the first embodiment only in the order in which the four toner strips are outputted; otherwise, the two are the same in operational sequence. Thus, the steps in the operational sequence of the first example of comparative image forming apparatus, shown in FIG. 6, which are the same as the counterparts in the first embodiment, are given the same referential codes as the counterparts, and are not going to be described here in order not to repeat the same description.

Referring to FIG. 6 along with FIG. 1, the first example of comparative image forming apparatus makes the four image formation stations 1 sequentially form four toner strips, one for one, starting from the image formation station 1Y for forming a yellow toner image, that is, the most upstream image formation station in terms of the moving direction of the intermediary transfer belt 8, and transfers (primary transfer) them onto the intermediary transfer belt 8 (W3).

Next, referring to FIG. 7 along with FIG. 2, the image forming apparatus 100 was used to output a substantial number of prints, while outputting toner strips, different in color, for every 100 prints. Then, the image forming apparatus 100, that is, the apparatus in the first embodiment, was compared with the first example of comparative image forming apparatus, in terms of the amount of cleaning blade deformation. In the case of the first example of comparative image forming apparatus, the cleaning blade 12*b* suffered from a large amount of compressional deformation with the same timing as the arrival of the yellow toner strips at the cleaning blade 12*b*, as shown in FIG. 7(*a*). In comparison, in the case of the image forming apparatus 100 in the first embodiment, the cleaning blade 12*b* did not suffer from a large amount of compressional deformation when the black toner strip QBk, or the most upstream one, reached the cleaning blade 12*b*, as shown in FIG. 7(*b*). Further, even when the cyan, magenta, and yellow toner strips QC, QM and QY sequentially reached the cleaning blade 12*b*, the blade 12*b* did not sustain conspicuous amount of compressional deformation.

<Modified Version of Embodiment 1>

Although this modified version (first version) of the first embodiment is similar to the first embodiment in that the first toner strip sent to the cleaning blade 12*b* was the toner strip QBk, that is, the toner strip formed in the image formation station 1Bk, it is different from the first embodiment in terms of the order in which the cyan, magenta, and yellow toner strips QC, QM and QY were sent to the cleaning blade 12*b* after the black toner strip QBk. The image forming apparatus in this modified version of the first embodiment was subjected to the same experiment as the one described above. The results of the experiment were the same as those obtained by the image forming apparatus 100 in the first embodiment, confirming that the first embodiment is effective regardless of the order in which the yellow, magenta, and cyan toner strips are delivered to the cleaning blade 12*b*. That is, an image forming apparatus can be very effectively prevented from failing to satisfactorily clean its intermediary transfer belt 8, simply by controlling the apparatus in such a manner that when the apparatus forms the toner strips for controlling the apparatus, it makes the image formation station 1Bk, that is, the most downstream one, the first one to form a toner strips, or the black toner strip.

Further, the intermediary transfer belt 8 was stopped immediately after the black toner strip QBk, that is, the toner strip formed in the image formation station 1Bk, was sent to the cleaning blade 12*b*. Then, the cleaning blade 12*b* was removed from the image forming apparatus 100. Then, its cleaning edge was examined with the use of a stereo-microscope. The examination proved the presence of a toner layer; a toner layer was formed by the black toner strip QBk.

The experiment carried out with the use of the image forming apparatus in the first modified version of the first embodiment proved that as long as a toner strip which is small in the amount of load to which the cleaning blade 12*b* is subjected when the cleaning blade 12*b* scrapes away a toner image on the intermediary transfer belt 8 is the first one to be sent to the cleaning blade 12*b* during an operation for adjusting (correcting) an image forming apparatus in image density, a toner layer is formed along the cleaning edge of the cleaning blade 12*b*. The amount of the impact to which the cleaning blade 12*b* is subjected by a toner strip is affected by the amount of toner per unit area of the toner strip. Therefore, the image forming apparatus 100 is controlled so that a toner strip which is small in the amount of its toner per unit area will be the first one to be transferred onto the intermediary transfer belt 8, and then, those which are larger in the amount of toner per unit area are transferred onto the intermediary transfer belt 8.

Once a toner layer is formed along the cleaning edge of the cleaning blade 12*b*, the cleaning blade 12*b* substantially reduces anyway in the amount by which it is deformed by a toner image on the intermediary transfer belt 8. Thus, it is not mandatory that the toner strips are to be sequentially formed and transferred onto the intermediary transfer belt 8, starting from the one which is formed in the most downstream image formation station. In other words, the modified version of the first embodiment also can prevent the cleaning edge of a cleaning blade from being deformed and/or reduced in service life by the toner strip formed to control an image forming apparatus, and therefore, can make it unlikely for the cleaning blade to fail to satisfactorily clean the intermediary transfer belt.

Further, the effects of the first embodiment can be enhanced by reducing to zero (0 μA) the current which is to be flowed in the primary transfer station when toner images other than the toner images formed and transferred onto the intermediary transfer medium to be measured in density are moved between the primary transfer means and an image bearing member.

Experiment 2

Figure 8:
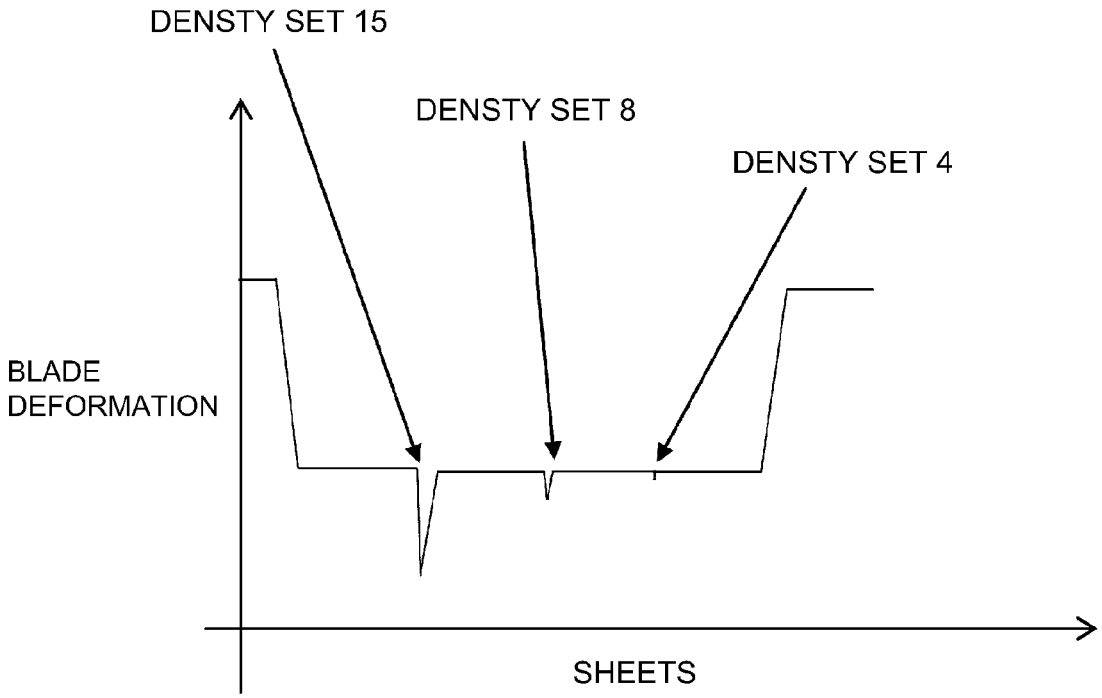
FIG. 8 is a graph which shows the relationship between the amount per unit area by which toner is adhered to the intermediary transfer belt of the image forming apparatus in the first embodiment, to form toner strips for adjusting the image forming apparatus on the intermediary transfer belt, and the amount of the deformation which the toner strips caused to the cleaning blade.

FIG. 8 is a drawing for describing the relationship between the amount of toner per unit area of a toner strip and the amount of the deformation of the cleaning blade 12*b*. The image forming apparatus 100 shown in FIG. 1 was used to continuously output a substantial number of prints, while controlling the image forming apparatus 100 in such a manner that adjustment toner strips are formed and transferred onto the intermediary transfer belt 8 in the image formation stations 1Y for forming a yellow toner strips, for every 100 prints, and also, that the yellow stripes become different in the amount of toner per unit area. The toner strips different in the amount of toner per unit area, were moved through the secondary transfer station T2 while applying negative voltage to the secondary transfer roller 10, and then, were recovered by the belt cleaning device 12.

The amount by which toner was adhered to the peripheral surface of a photosensitive drum to form a toner strip was set by changing the DC voltage VD of the alternating voltage to be applied to the charge rollers 3Y, 3M, 3C and 3Bk in order to adjust an electrostatic latent image in the development contrast, which is the different in potential level between the AC voltage of the alternating voltage to be applied to the development sleeve of the developing device, and the potential level of the toner particles on the photosensitive drum. More concretely, the image forming apparatus 100 was designed so that the density of the yellow toner strip QY can be set in steps between Levels 15 and 1, a level 15 being the highest level of density. As the image forming apparatus is lowered in steps in the density setting for the yellow toner strip, from Level 15 (14, 13, 12 . . . 2, 1), the yellow toner strip reduces in the amount of toner per unit area. When the density setting is 0, the image forming apparatus does not form a yellow toner strip.

Referring to FIG. 8, when two toner strips are the same in the number of times they moved through the primary transfer station, the one which was greater in the density setting, and therefore, greater in the amount of toner per unit area, was greater in the amount of the compressional deformation it caused to the cleaning blade 12*b*. Further, changing the image formation station 1Y in density setting changed the amount of the compressional deformation which the cleaning blade 12*b* sustained when the toner strip QY arrived at the cleaning blade 12*b*.

A toner strip formed in an image formation station 1 which was relatively low in density setting (Level 4, for example), caused hardly any deformation to the cleaning blade 12*b*. On the other hand, a toner strip formed in an image formation station 1 which was higher in density (Level 15, for example) caused a substantial amount of deformation to the cleaning blade 12*b*. That is, it was confirmed that the density setting for an image formation station affects the amount by which the cleaning blade 12*b* is deformed; the higher the density setting, the greater will be the amount of the deformation which the cleaning blade will sustain.

To elaborate, the greater a toner strip in the amount of toner per unit area, the greater the amount of the load to which the cleaning blade 12*b* will be subjected when it scrapes away the toner strip, and therefore, the greater the amount by which the cleaning edge of the cleaning blade 12*b* deforms by being pushed downstream by the toner strip in terms of the moving direction of the intermediary transfer belt 8. On the contrary, the smaller a toner strip in the amount of toner per unit area, the smaller of the amount of the load to which the cleaning blade 12*b* will be subjected when it scrapes away the toner strip, and therefore, the smaller the amount by which the cleaning edge of the cleaning blade 12*b* is pushed downstream by the toner strip in terms of the moving direction of the intermediary transfer belt 8.

Embodiment 2

Figure 9:
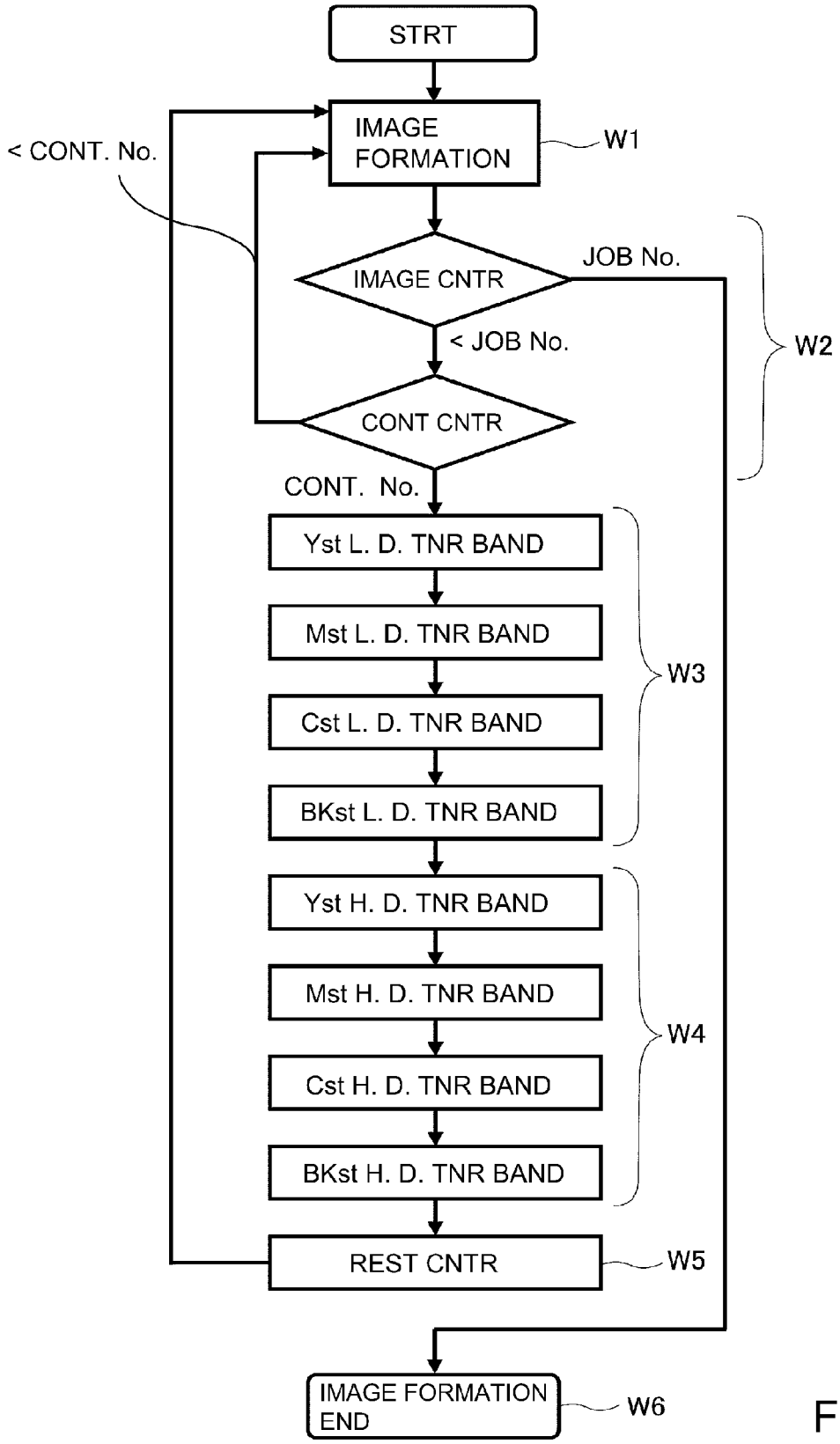
FIG. 9 is a flowchart of the operational sequence of the image forming apparatus in the second embodiment, for forming toner strips for adjusting the image forming apparatus.

FIG. 9 is a flowchart of the operational sequence to be carried out by the image forming apparatus in the second embodiment of the present invention, in order for the apparatus to form toner strips for adjusting (controlling) the apparatus. In the second embodiment, based on the results of the second experiment, a toner strip which is low in density, being therefore small in the amount of the load upon the cleaning blade 12*b* is the first one to be delivered to the cleaning blade 12. That is, when multiple toner strips are sequentially transferred onto the intermediary transfer belt 8 and are sent to the cleaning blade 12*b*, the toner strip which is the lowest in density is the first one to be formed so that it will be recovered first by the cleaning blade 12*b*. Thus, a toner layer is formed along the cleaning edge of the cleaning blade 12*b* by the toner strip which is low in density, being therefore small in the amount of load upon the cleaning blade, before the subsequent toner strips which are higher in density are recovered by the cleaning blade 12*b*. Therefore, the amount of load to which the cleaning blade 12*b* in this embodiment is subjected when the toner strips which are greater in the amount of toner per unit area collide with the cleaning blade 12*b* is significantly smaller than that to which a cleaning blade (12*b*) of any electrophotographic image forming apparatus in accordance with the prior art is subjected.

Next, referring to FIG. 9 along with FIG. 1, as the control section 110 receives an image formation job, it makes the image forming apparatus 100 begin an image forming operation, and begins to count the number of prints formed (W1). As the print count reaches the print count value of the job (value in image formation counter in W2), the control section 110 ends the image forming operation (W6). Each time the print count reaches the preset value (value in counter in W2), the control section 110 makes the image forming apparatus 100 form four toner strips which are low in density, on the photosensitive drums 2Y, 2M, 2C and 2Bk, one for one, and transfer the toner strips onto the intermediary transfer belt 8. In this embodiment, the preset value in the counter in W2 is 100. The four toner strips are conveyed to the belt cleaning device 12, scraped away from the intermediary transfer belt 8 by the cleaning blade 12*b* of the cleaning device 12, and recovered by the cleaning device 12 (W3). Then, the control section 110 makes the image forming apparatus 100 form four toner strips which are higher in density on the photosensitive drums 2Y, 2M, 2C and 2Bk, one for one, transfer the toner strips onto the intermediary transfer belt 8, and scrape them away from the intermediary transfer belt 8 with the cleaning blade 12*b*, and recover them into the cleaning device 12.

<Example 2 of Comparative Image Forming Apparatus>

Figure 10:
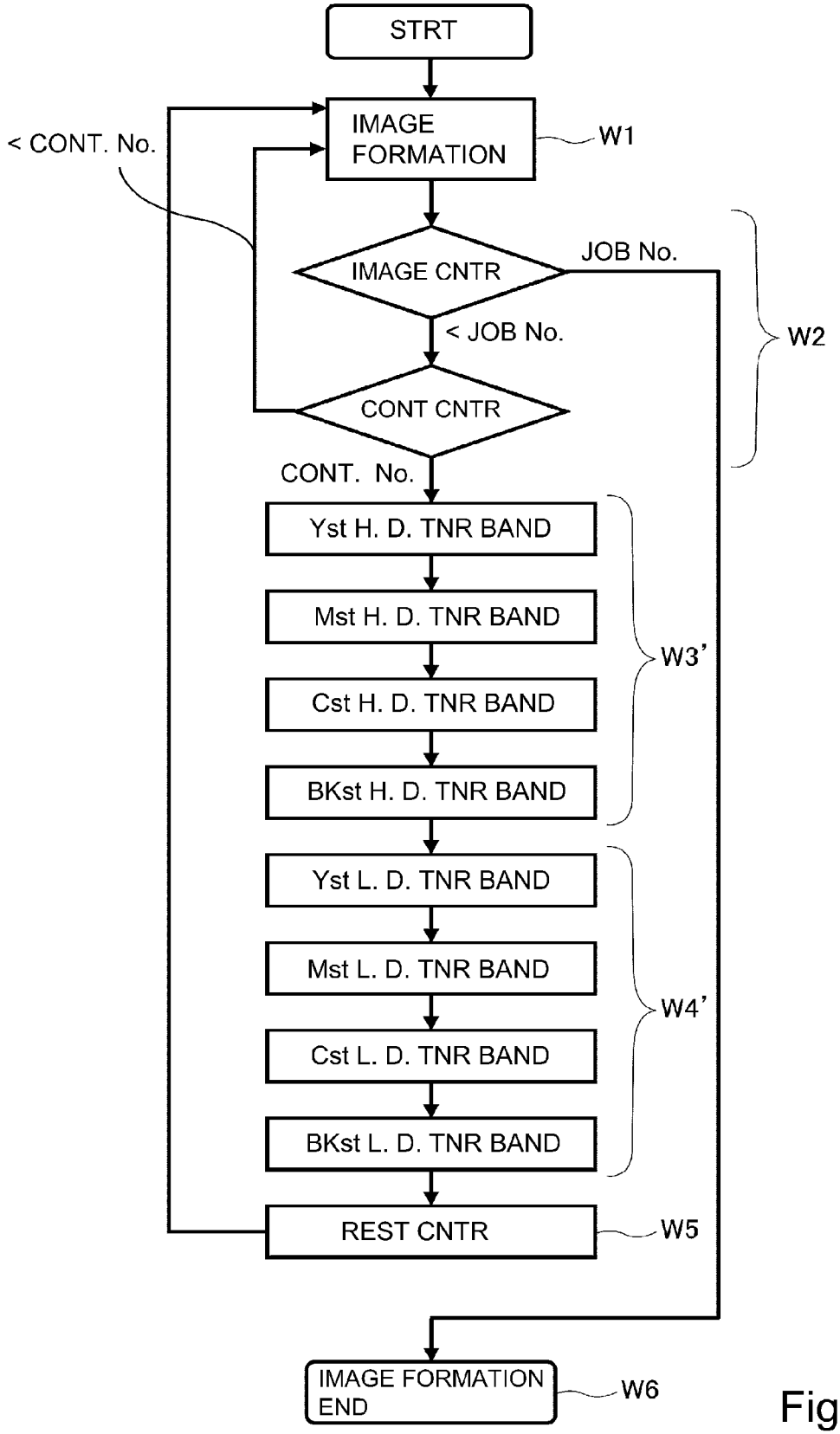
FIG. 10 is a flowchart of the operational sequence of the second comparative image forming apparatus, for forming toner strips for adjusting the image forming apparatus.
Figure 11:
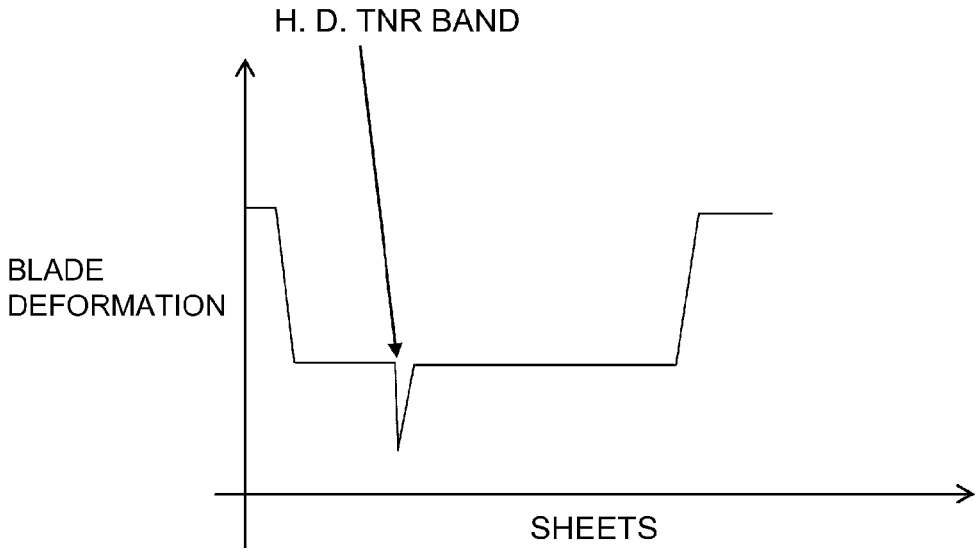
FIG. 11 is a drawing for describing the effect of the second embodiment of the present invention.
Figure 11:
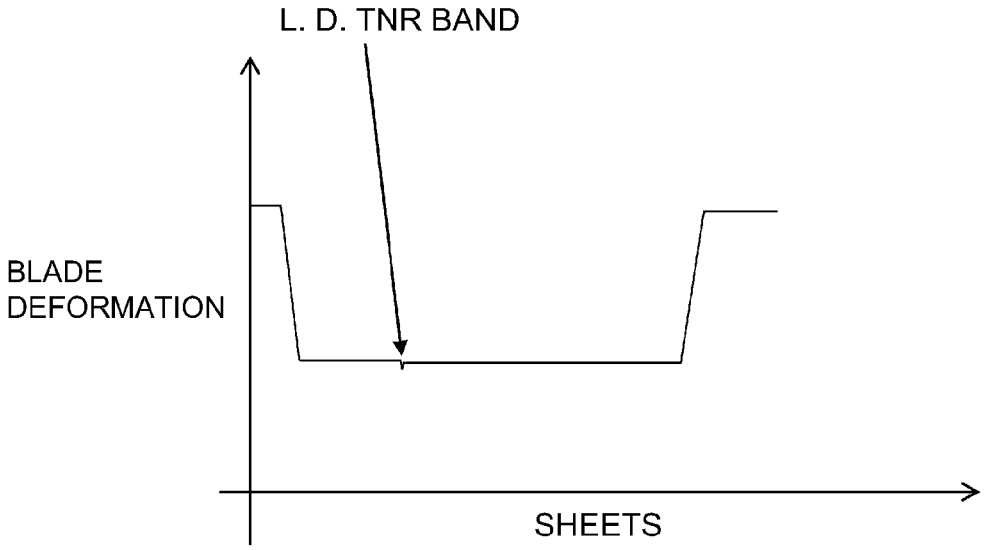

FIG. 10 is a flowchart of the toner strip forming sequence of the second example of comparative image forming apparatus, and FIG. 11 is a drawing for describing the effects of the second embodiment.

The second example of comparative image forming apparatus transfers the aforementioned adjustment toner strips onto the intermediary transfer belt 8 in the conventional order, that is, the reverse order to the one in the second embodiment.

That is, the second example of comparative image forming apparatus is different from the image forming apparatus in the second embodiment only in the order in which the adjustment toner strips are formed; otherwise, it is the same as the image forming apparatus in the second embodiment. Thus, the steps in the operational sequence of the second example of comparative image forming apparatus, shown in FIG. 10, which are the same as the counterparts in the second embodiment, are given the same referential codes as the counterparts, and are not going to be described here in order not to repeat the same description.

Referring to FIG. 10 along with FIG. 1, the control section 110 makes the second example of comparative image forming apparatus sequentially form four toner strips which are higher in density setting, on the photosensitive drums 2Y, 2M, 2C and 2Bk, one for one, and transfer them onto the intermediary transfer belt 8. Then, the control section 110 makes the image forming apparatus convey the toner strips to the cleaning device 12, scrape the toner strips away from the intermediary transfer belt 8 with the use of the cleaning blade 12*b*, and recover the toner resulting from the scraping (W3'). Then, the control section 110 makes the image forming apparatus form toner strips, which are lower in density setting, on the photosensitive drums 2Y, 2M, 2C and 2Bk, one for one, and process the toner strips in the same manner as the toner strips which are higher in density setting were processed (W4').

Next, referring to FIG. 11 along with FIG. 2, the image forming apparatus 100 was used to output a substantial number of prints, while outputting adjustment toner strips, different in color, for every 100 prints. Then, the image forming apparatus 100, that is, the apparatus in the second embodiment, was compared with the second example of comparative image forming apparatus, in terms of the amount of the cleaning blade deformation which occurred when the toner strips arrived at the cleaning blade 12*b* for the first time. The image forming apparatus in the second embodiment, which forms the toner strip which are higher in density setting, after it forms the toner strips which are lower in density setting, was smaller in the amount of the deformation of the cleaning blade 12*b* than the image forming apparatus which forms the toner strips in the reverse order to the order in which the second example of comparative image forming apparatus forms the toner strips.

<Modified Version of Embodiment 2>

The image forming apparatus 100 can be operated in such a manner that multiple toner strips for adjusting the apparatus 100 in properties, which are different in density setting, are formed with the presence of physical intervals. As for the typical usage for the toner strips which are relatively high in density setting, they are transferred onto the intermediary transfer belt 8 to be measured in the amount of toner per unit area to control an electrostatic image forming apparatus in Dmax (highest level of density), and/or to rejuvenate the developer in a developing device, for example. In the case of a toner strip which is formed to make a developing device simply expel a certain amount of toner to rejuvenate the developer in the developing device, and therefore, does not need to be measured in the amount of toner per unit area, it does not need to be controlled in density level and development contrast. Thus, it can be utilized as the adjustment toner strip in the second embodiment, which is smaller in the amount of toner per unit area.

Thus, when the image forming apparatus in a modified version of the second embodiment, is made to sequentially form toner strips with equal physical intervals in order to control the apparatus in Dmax or rejuvenate the developer in the developing device, a toner strip (strips), the density setting of which is lower than the normal toner image, is sent to the cleaning edge of the cleaning blade 12*b* before the toner strips for adjusting (controlling) the apparatus are sent. Then, the toner strips for Dmax control (adjustment) or the toner strips for automatically rejuvenating the developer in the developing device are sent to the cleaning blade 12*b* to ensure that the apparatus adjustment toner strips, which are higher in density setting, will be scraped away by the cleaning edge of the cleaning blade 12*b* after the cleaning edge is provided with a supple amount of toner particles.

In the modified version of the second embodiment, in a case where the timing with which the toner strips for controlling the image forming apparatus in Dmax are formed coincides with the timing with which the toner strips for rejuvenating the developer in the developing device, the control operation which uses the toner strips which are lower in density setting is carried first, and then, the control operation which uses the toner strips which are higher in density setting is carried out. Further, after the expelling of a preset amount of toner from the developing device, the amount by which toner is adhered to the intermediary transfer belt 8 is measured. Then, the control operation which uses the toner strips which are smaller in the amount of toner per unit area is carried first, and then, the control operation which uses the toner images strips which are larger in the amount of toner per unit area is carried out.

In a case where the timing with which the toner strips which are higher in density setting coincides with the timing with which the toner strips which are lower in density setting, the toner strip which is lower in density setting and is to be formed in the downstream image formation station in terms of the moving direction of the intermediary transfer belt 8 is formed first. It the timing with which a toner strip which is greater in the amount of toner per unit area is transferred onto the intermediary transfer belt 8 coincides with the timing with which a toner strip which is smaller in the amount of toner per unit area is transferred onto the intermediary transfer belt 8, the toner strip which is smaller in the amount of toner per unit area is formed first.

With the image forming apparatus 100 being controlled as described above, the modified version of the second embodiment is just as effective as the second embodiment in terms of the reduction of the deformation of the cleaning edge of the cleaning blade 12*b* which occurs as an apparatus adjustment toner strip which is greater in the amount of toner per unit area arrives at the cleaning blade 12*b*. That is, the modified version of the second embodiment also can provide an electrophotographic image forming apparatus, which is significantly smaller in the amount of the load to which the cleaning edge of its cleaning blade is subjected, being therefore significantly smaller in the amount of the deformation of the cleaning edge. That is, the modified version of the second embodiment also can prevent an image forming apparatus from suffering from the problem that it is reduced in image quality by the unsatisfactory cleaning of its intermediary transfer belt (or recording medium conveyance belt) by its cleaning blade.

<Second Modified Version of Embodiment 2>

Figure 12:
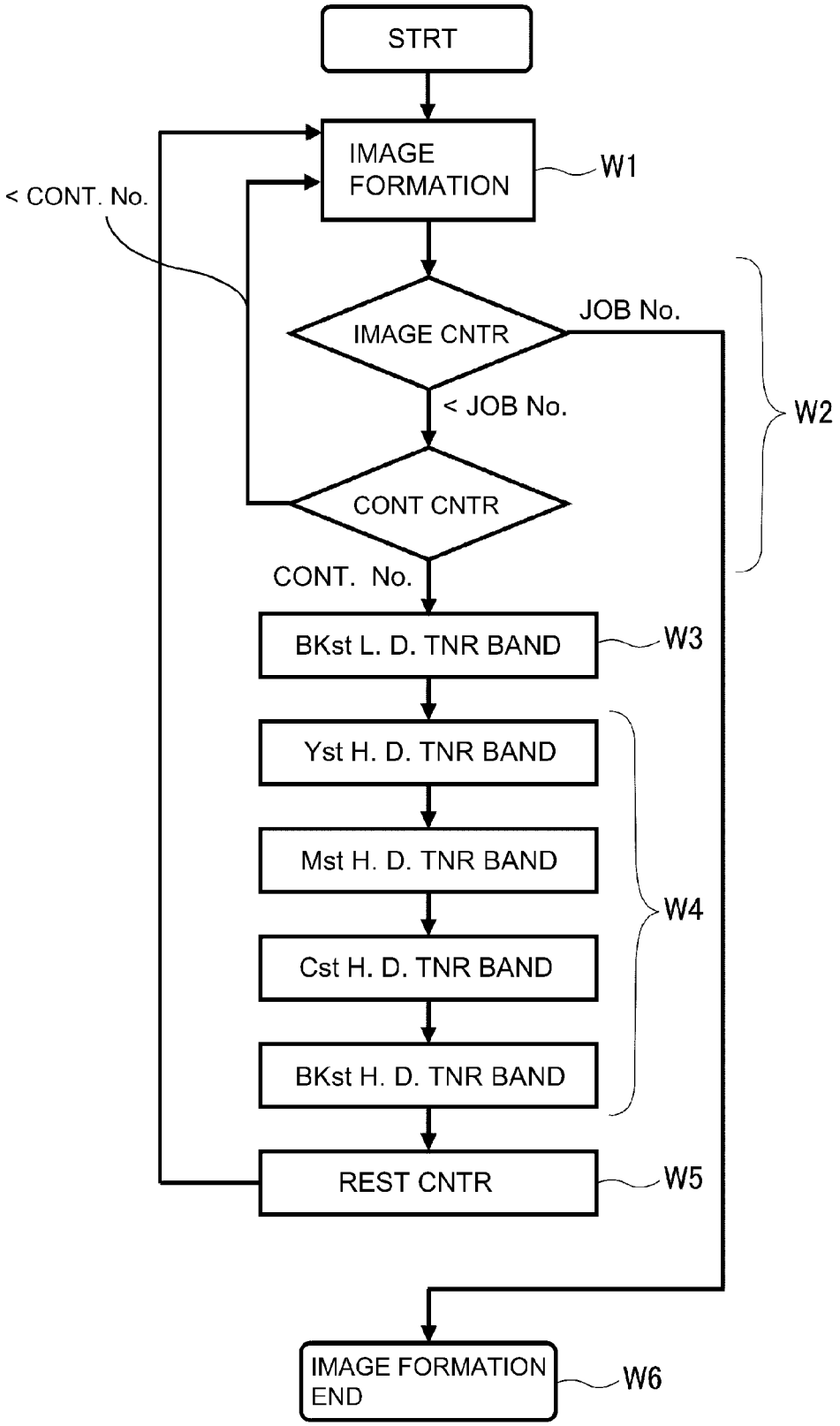
FIG. 12 is a flowchart of the operational sequence of the image forming apparatus in a modified version of the second embodiment, for forming toner strips for adjusting the image forming apparatus.

FIG. 12 is a flowchart of the toner strip forming operation of the image forming apparatus in the second modified version of the second embodiment. The first modified version of the second embodiment was related to the control to be carried out when the timing with a toner strip which is higher in density setting is formed becomes coincidental with the timing with which a toner strip which is lower in density setting is formed. In comparison, in the second modified version of the second embodiment, in a case where an electrophotographic image forming apparatus is controlled (adjusted) in Dmax (or developer in developing device is rejuvenated), using toner images strips which are higher in density setting, a toner strip which is lower in density setting and has nothing to do with the control (adjustment) is intentionally formed. That is, a lubricational toner image is formed in the most downstream image formation station, with the density set lower than the apparatus adjustment toner strips. Therefore, it is smaller in the amount of toner per unit area of intermediary transfer belt 8 than the apparatus adjustment toner image strips formed in the image formation stations other than the most downstream one.

A lubricational toner image strip is formed to be longer than the apparatus adjustment toner strips in terms of the belt width direction, that is, the direction perpendicular to the moving direction of the intermediary transfer belt 8.

The second embodiment and the second modified version of the second embodiment are the same except that in the second modified version of the second embodiment, the formation of a toner strip which is lower in density setting is limited to the image formation station 1Bk. Therefore, the steps in the operational sequence of the second example of comparative image forming apparatus, shown in FIG. 12, which are the same in content as the counterparts in the second embodiment, are given the same referential codes as the counterparts, and are not going to be described here in order not to repeat the same description.

Referring to FIG. 12, in the second modified version of the second embodiment, before toner strips which are higher in density setting are formed (W4), a toner strip which is lower in density setting is formed and transferred onto the intermediary transfer belt 8, and is recovered by the belt cleaning device 12 (W3). As long as a supple amount of toner is remaining along the cleaning edge of the cleaning blade 12*b*, the high density toner strips may be formed with the presence of gaps or no gaps among them.

In the second modified version of the second embodiment, a toner strip which is low in density setting was formed in the black image formation station 1Bk. However, it may be formed in any one of the image formations other than the black image formation station 1Bk. In a case where only a single toner strip which is higher in density setting is formed, a toner strip which is lower in density setting is to be formed in one of the image formation stations which are on the downstream side of the image formation station in which the high density toner strip is formed, in terms of the moving direction of the intermediary transfer belt 8. Further, in a case where only a single toner strip which is greater in the amount of toner per unit area is formed, a toner strip which is smaller in the amount of toner per unit area than the single toner strip which is greater in the amount of toner per unit area, is formed and supplied to the cleaning edge of the cleaning blade 12*b* before the toner strip which is greater in the amount of toner per unit area is formed.

The second modified version of the second embodiment also can minimize the amount by which the cleaning blade 12*b* of the apparatus 100 is deformed, by reducing the image forming apparatus 100 in the amount of the load to which the cleaning blade of the apparatus 100 is subjected. That is, it can prevent the cleaning device of an electrophotographic image forming apparatus from unsatisfactorily cleaning the intermediary transfer belt of the image forming apparatus.

Regarding the discharging of toner onto a photosensitive drum, it sometimes occurs that four image formation stations, different in the color of the toner they use, are made to simultaneously discharge toner. It is also possible that toner consumption occurs mostly to three of the four image formation stations, and therefore, only one of the four image forming stations is made to discharge toner. In such a case, only the image formation station which was low in toner consumption is made to form a toner strip for causing a developing device to discharge a preset amount of toner, and transfer the toner strip onto the intermediary transfer belt, with such a timing that the toner strip will follow a lubricational toner strip on the intermediary transfer belt. Also in such a case, the lubricational toner strip is desired to be formed in the most downstream image formation station, as in the first embodiment. Further, from the standpoint of minimizing wasteful toner consumption, a lubricational toner strip is desired to be as small as possible in the amount of toner per unit area.

Embodiment 3

The apparatus adjustment toner strips formed by the image forming apparatuses in the first and second embodiments, in order to measure the amount by which toner is adhered to the peripheral surface of a photosensitive drum, must be transferred onto the intermediary transfer belt 8 so that the toner strips can be measured in the amount of toner per unit area. However, a toner strip for causing the developing device 4Y to discharge a preset amount of toner does not need to be measured in the amount of toner per unit area. Therefore, it does not need to be transferred onto the intermediary transfer belt 8. In other words, it is not necessary that the toner strip formed on the photosensitive drum 2Y is entirely transferred onto the intermediary transfer belt 8.

Thus, in a case where a toner strip which does not need to be measured in the amount of toner per unit area is transferred (primary transfer) onto the intermediary transfer belt 8, the transfer current is reduced from 50 μA, which makes the primary transfer roller highest in transfer efficiency. More concretely, the control section 110 makes the efficiency with which a lubricational toner strip is transferred onto the intermediary transfer belt 8 lower than the efficiency with which the apparatus adjustment toner strips formed in the image forming stations other than the most downstream one, are transferred onto the intermediary transfer belt 8. Reducing transfer current lowers the transfer efficiency, which in turn reduces the amount by which the toner particles in the lubricational toner strip is transferred (primary transfer) onto the intermediary transfer belt 8, reducing thereby the amount of the load to which the cleaning edge of the cleaning blade 12*b* is subjected when the lubricational toner strip is scraped away by the cleaning blade 12*b*. Further, reducing the transfer current weakens the bond among the toner particles in the toner strip on the intermediary transfer belt 8, further reducing the amount of the load to which the cleaning edge of the cleaning blade 12*b* is subjected when the cleaning blade 12*b* scrapes away the toner strip.

From the standpoint of enhancing the effects of the third embodiment, the transfer current for the primary transfer station TY may be reduced to 0 μA. The amount of the voltage to be applied to the primary transfer station TY when a toner strip other than the one formed to be measured in the amount of toner per unit area on the intermediary transfer belt 8 is moved through the primary transfer station TY, may be fixed to the value immediate before the transfer current begins to flow.

Embodiment 4

The image forming apparatuses in the first and second embodiments employed the intermediary transfer belt 8. However, the first and second embodiments are applicable to an image forming apparatus which employs a recording medium conveyance belt to which a sheet of recording medium is adhered to be conveyed sequentially through multiple image formation stations of the apparatus so that multiple toner images are transferred in layers onto the sheet of recording medium, as disclosed in the first patent document described above (Japanese Laid-open Patent Application 2002-311719).

An image forming apparatus which transfers an apparatus adjust toner strip onto its recording medium conveyance belt, and scrapes the toner strip away from the belt with its cleaning blade, suffers from the same problem as the image forming apparatuses in the first and second embodiments, which have the intermediary transfer belt 8, because it is possible for a sheet of recording medium to be soiled by coming into contact with the recording medium conveyance belt which failed to be properly cleaned by a cleaning blade. Thus, the recording medium conveyance belt also has to be superbly cleaned. That is, the present invention is applicable to any image forming apparatus which employs a component in the form of a belt, and a cleaning blade for cleaning the component in the form of a belt. That is, not only is the present invention applicable to an image forming apparatus such as those in the preceding embodiment, but also, a copying machine, a printer, a facsimile machine, and a multifunction image forming apparatus capable of two or more functions of the preceding image forming apparatus, as long as they employ a component which is in the form of a belt, and a cleaning blade for cleaning the component in the form of a belt.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 014449/2012 filed Jan. 26, 2012 which is hereby incorporated by reference.

What is claimed is:

1. An image forming apparatus comprising:

a movable belt member;

a cleaning blade contacted to said belt member;

a plurality of image forming stations including a first image forming station and a second image forming station configured to form first and second adjustment toner images, respectively, on said belt member in a transfer portion, said second image forming station being disposed in a downstreammost position among said plurality of image forming stations, and said first image forming station being disposed upstream of said second image forming station and downstream of said cleaning blade with respect to a moving direction of said belt member;

a detecting member configured to detect the first adjustment toner image and the second adjustment toner image, at a position opposing said belt member;

a changing portion configured to change image forming conditions of said image forming stations on the basis of a result of detection of said detecting member, and a controller configured to control said first image forming station and said second image forming station such that both the first adjustment toner image and the second adjustment toner image are formed on said belt member within an area between toner images which are sequentially transferred onto recording materials, and the first adjustment toner image overlaps the second adjustment toner image with respect to a width direction of said belt member transverse to the moving direction of said belt member, and the second adjustment toner image in the area reaches said cleaning blade before the first adjustment toner image in the area reaches said cleaning blade.

2. An apparatus according to claim 1, wherein said belt member is an intermediary transfer belt, and said image forming stations include photosensitive members, respectively.

3. An apparatus according to claim 1, wherein the adjustment toner images include at least one of a toner image configured to adjust a charge amount of the toner and a toner image configured to adjust a density of an image.

4. An image forming apparatus comprising:

a movable belt member;

a cleaning blade contacted to said belt member;

image forming stations configured to form an adjustment toner image and a supply toner image on said belt member, said image forming stations including a transfer member configured to transfer toner images onto said belt member, and a voltage source capable of changing a transfer efficiency of the toner images onto said belt member by changing a voltage applied to said transfer member;

a detecting member configured to detect the adjustment toner image at a position opposing said belt member;

a changing portion configured to change image forming conditions of said image forming stations on the basis of a result of detection of said detecting member, and a controller configured to control said image forming stations such that both the adjustment toner image and the supply toner image are formed on said belt member within an area between toner images which are sequentially transferred onto recording materials, and to control said voltage source such that the transfer efficiency of the supply toner image onto said belt member is lower than a transfer efficiency of the adjustment toner image onto said belt member, wherein the adjustment toner image overlaps the supply toner image with respect to a width direction of said belt member transverse to the moving direction of said belt member, and wherein the supply toner image in the area reaches said cleaning blade before the adjustment toner image in the area reaches said cleaning blade.

5. An apparatus according to claim 4, wherein said belt member is an intermediary transfer belt, and said image forming stations include photosensitive members, respectively.

6. An apparatus according to claim 4, wherein each of said image forming stations further includes a developing device for developing a latent image into a toner image, and the supply toner image is discharged from said developing device and is supplied to said cleaning blade.

* * * * *